United States Patent [19]

Salathé et al.

[11] Patent Number: 4,563,192

[45] Date of Patent: Jan. 7, 1986

[54] PROCESS FOR DYEING FIBRE MATERIAL MADE OF SYNTHETIC POLYAMIDES WITH ANIONIC DYES AND AN AUXILIARY MIXTURE

[75] Inventors: Heinz Salathé, Bretzwil, Switzerland; Hermann Flensberg, Weil am Rhein; Harry Schaetzer, Wehr, both of Fed. Rep. of Germany

[73] Assignee: Ciba-Geigy Corporation, Ardsley, N.Y.

[21] Appl. No.: 651,034

[22] Filed: Sep. 14, 1984

[30] Foreign Application Priority Data

Sep. 19, 1983 [CH] Switzerland ..... 5080/83

[51] Int. Cl.[4] ..... D06P 3/24

[52] U.S. Cl. ..... 8/554; 8/557; 8/591; 8/604; 8/606; 8/638; 8/641; 8/658; 8/676; 8/681; 8/682; 8/683; 8/685; 8/687; 8/924; 8/543

[58] Field of Search ..... 8/554, 557, 591, 606, 8/604, 638, 641, 639

[56] References Cited

U.S. PATENT DOCUMENTS

| | | | |
|---|---|---|---|
| 3,401,004 | 9/1968 | Krumme et al. | 8/551 |
| 3,684,426 | 8/1972 | Bindler et al. | 8/480 |
| 4,402,704 | 9/1983 | Raisin et al. | 8/641 |
| 4,444,563 | 4/1984 | Abel | 8/588 |
| 4,444,564 | 4/1984 | Salathe et al. | 8/588 |
| 4,445,905 | 5/1984 | Schaetzer et al. | 8/641 |

FOREIGN PATENT DOCUMENTS 1160343 8/1969 United Kingdom .

*Primary Examiner*—A. Lionel Clingman

*Attorney, Agent, or Firm*—Wenderoth, Lind & Ponack

[57] ABSTRACT

The invention relates to a process for dyeing synthetic polyamide fibre material with dyes or dye mixtures in the presence of a mixture of dyeing assistants, which comprises using for the dyeing of these materials an aqueous liquor which contains at least one anionic dye which, under the defined dyeing conditions, has a degree of exhaustion of at least 95% at 1/1 standard depth of shade, and a dyeing assistant mixture containing an anionic compound, a quaternary compound and a nonionic compound, and wherein the liquor contains an alkali metal salt and an organic acid, and finishing the dyeing at pH 5–7, preferably pH 5.5–6, and at a temperature of 95° to 130° C.

The process according to the invention is suitable for dyeing synthetic polyamide materials, producing level dyeings having good fastness properties with all types of dye or mixtures of dyes of identical or different types.

18 Claims, No Drawings

PROCESS FOR DYEING FIBRE MATERIAL MADE OF SYNTHETIC POLYAMIDES WITH ANIONIC DYES AND AN AUXILIARY MIXTURE

The present invention relates to a novel process for dyeing synthetic polyamide materials with anionic dyes of various dye classes in pale to dark shades from aqueous liquors and constant pH 5–7 irrespective of the depth of the dyeing and irrespective of the class of dye used, the dyebath being virtually completely exhausted and the dyeing having good allround fastness properties, in particular good wet fastness and good light fastness properties, and to the material dyed with the novel process.

The disadvantage of existing methods of dyeing synthetic polyamides is that dyeing must take place at different pH values depending not only on whether pale or dark shades are to be obtained but also on the class of dye to which the dye used belongs.

The dyebath pH is a critical factor in the reproducibility of dyeings of synthetic polyamide materials.

A further disadvantage of existing dyeing methods is that the dyeing assistants used for levelling out and covering up stripiness inherent in the material are adapted to be used in combination with a particular class of dye; in other words, the dyeing assistants used in the existing dyeing methods do not give equally good results with all classes of dye. In particular, the dyes used in combination shade dyeings of different classes of dye need to have been chosen with care.

We have now found, surprisingly, an integrated process which is free of the disadvantages and problems mentioned and permits synthetic polyamides to be dyed in a simple manner at pH 5–7 irrespective of the desired depth of shade and irrespective of the type of dye or even mixtures of different types of dye.

The present invention accordingly provides a process for dyeing synthetic polyamide fibre material with dyes or dye mixtures in the presence of a mixture of dyeing assistants, which comprises using for the dyeing of these materials an aqueous liquor which contains at least one anionic dye which, under the defined dyeing conditions, has a degree of exhaustion of at least 95% at 1/1 standard depth of shade, and a dyeing assistant mixture containing an anionic compound, a quaternary compound and a nonionic compound, and wherein the liquor contains an alkali metal salt and an organic acid, and finishing the dyeing at pH 5–7, preferably pH 5.5–6. and at a temperature of 95° to 130° C.

The preferred dyeing assistant mixture contains an anionic compound of the formula

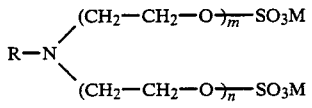

(1)

in which R is an alkyl or alkenyl radical having 12 to 22 carbon atoms, M is hydrogen, an alkali metal or ammonium, and m and n are integers such that m and n add up to 2 to 14, a quarternary compound of the formula

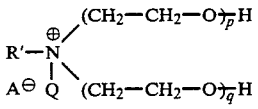

(2)

in which R′, independently of R, is defined in the same way as R, A is an anion, Q is a substituted or unsubstituted alkyl radical, and p and q are integers such that p and q add up to 20 to 50, and a nonionic compound of the formula

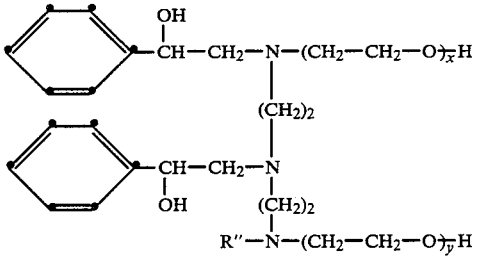

(3)

in which R″, independently of R, is defined in the same way as R, and x and y are integers such that x and y add up to 80 to 140.

The anionic dyes which can be used can belong to all classes of dye and can, if desired, contain one or more sulfonic acid groups and, if desired, one or more fibre-reactive groups. They are in particular triphenylmethane dyes having at least two sulfonic acid groups, monazo and disazo dyes which are free of heavy metals but which each contain one or more sulfonic acid groups and can, if desired, also contain one or more fibre-reactive groups, and monoazo, disazo, azomethine and formazan dyes which contain heavy metal, in particular copper, chromium, nickel or cobalt, in particular metallised dyes which contain, bonded to a metal atom, two molecules of azo dye of one molecule of azo dye and one molecule of azomethine dye, especially those which contain monoazo and/or disazo dye and/or azomethine dye ligands and a chromium or cobalt ion as the central metal ion, as well as anthraquinone dyes, in particular 1-amino-4-arylaminoanthraquinone-2-sulfonic acids or 1,4-diarylamino- or 1-cycloalkylamino-4-arylaminoanthraquinonesulfonic acids. Fibre-reactive groups are to be understood as meaning groups which enter a covalent bond with the synthetic polyamide material.

The amounts in which the dyes are used in the dyebaths can vary within wide limits according to the desired depth of shade, but amounts of 0.001 to 6 percent by weight (on weight of fibre) of one or more dyes have generally been found to be advantageous.

1/1 standard depth of shade is understood as meaning the depth of shade designated 1/1 in DIN (German standard) 54,000.

A degree of exhaustion of at least 95% means that less than 5% of the amount of dye used in the process according to the invention remains behind in the bath after the dyeing.

If desired, it is also possible to use mixtures of anionic dyes in the process according to the invention. Preferred mixtures of anionic dyes of the type defined contain (a) at least two dyes; or (b) at least three dyes; or (c) for trichromatic dyeing, at least three dyes from among yellow- or orange-, red- and blue-dyeing dyes.

Trichromatic dyeing is to be understood as meaning the additive colour mixture of suitably chosen yellow- or orange-, red- and blue-dyeing dyes with which any desired shade of the visible spectrum can be matched by a suitable choice of the mixing ratios of the dyes.

The anionic dyes preferably used in the process according to the invention have, under the defined dyeing conditions, a degree of exhaustion of at least 97% at 1/1 standard depth of shade.

Suitable anionic dyes belong in particular to the following classes of dye:

(a) triphenylmethane dyes having at least two sulfonic acid groups of the formula

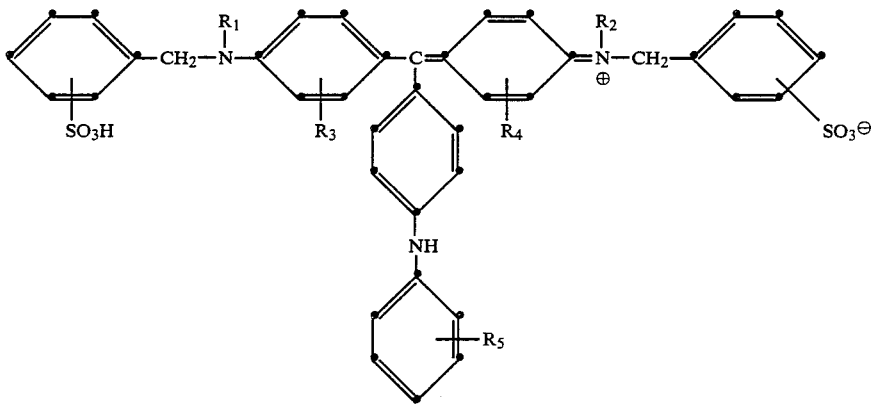

(4)

in which $R_1$ and $R_2$, independently of each other, are each $C_{1-4}$-alkyl, $R_3$ and $R_4$ are hydrogen or $C_{1-4}$-alkyl and $R_5$ is $C_{1-4}$-alkyl, $C_{1-4}$-alkoxy or hydrogen;

(b) monoazo and disazo dyes of the formulae

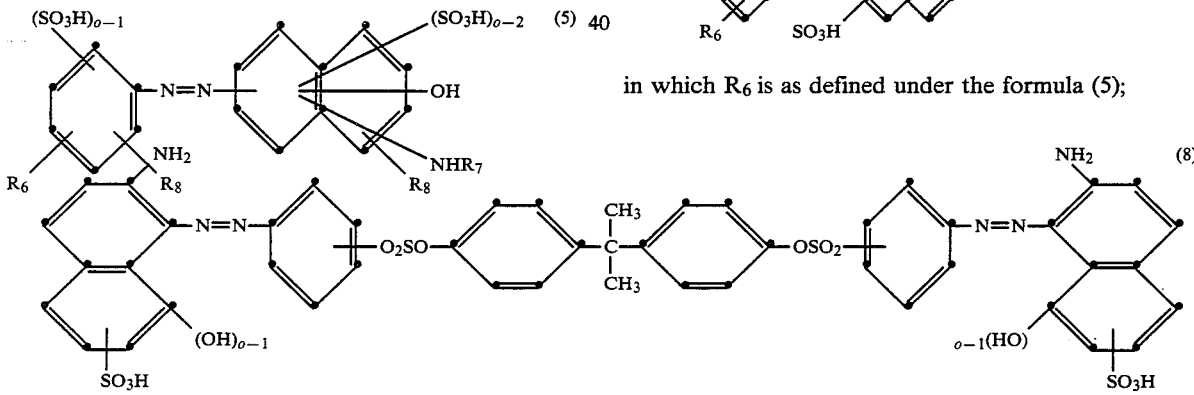

(5)

in which $R_6$ is a fibre-reactive group bonded via a —NH— group or benzoylamino, phenoxy, chlorophenoxy, dichlorophenoxy or methylphenoxy, $R_7$ is hydrogen, benzyl, phenyl, $C_{1-4}$-alkyl, phenylsulfonyl, methylphenylsulfonyl or a fibre-reactive group which can be bonded via aminobenzoyl, and the $R_8$s, independently of each other, are each hydrogen or a phenylamino or N-phenyl-N-methylaminosulfonyl radical;

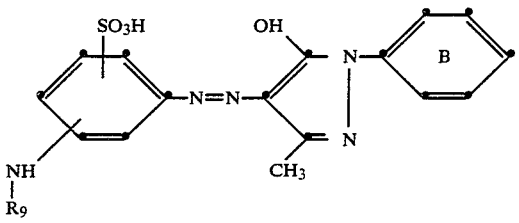

(6)

in which $R_9$ is a fibre-reactive group and the phenyl ring B can be substituted by halogen, $C_{1-4}$-alkyl and sulfo;

(7)

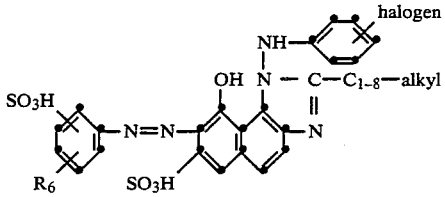

in which $R_6$ is as defined under the formula (5);

(8)

(c) 1:2 metal complex dyes, such as 1:2 chromium complex dyes of azo and azomethine dyes of the formula

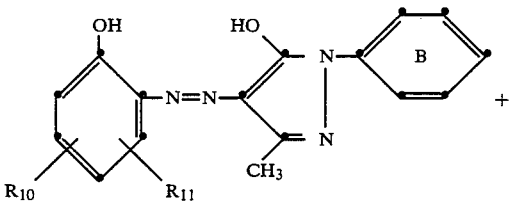

(9)

-continued

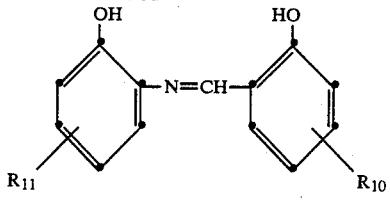

in which $R_{10}$ is hydrogen, sulfo or phenylazo, $R_{11}$ is hydrogen or nitro, and the phenyl ring B can contain the substituents given under the formula (6);

(d) 1:2 metal complex dyes, such as symmetrical 1:2 chromium complex dyes of azo dyes of the formulae

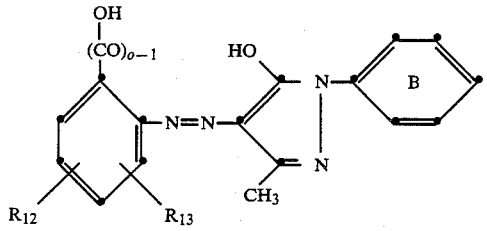

(10)

in which the phenyl ring B can contain the substituents given in the formula (6), and $R_{12}$ and $R_{13}$, independently of each other, are each hydrogen, nitro, sulfo, halogen, $C_{1-4}$-alkylsulfonyl, $C_{1-4}$-alkylaminosulfonyl or $-SO_2NH_2$;

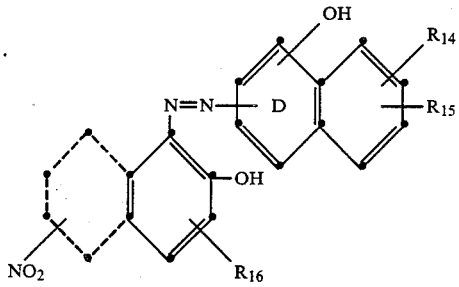

(11)

in which $R_{14}$ is hydrogen, $C_{1-4}$-alkoxycarbonylamino, benzoylamino, $C_{1-4}$-alkylsulfonylamino, phenylsulfonylamino, methylphenylsulfonylamino or halogen, $R_{15}$ is hydrogen or halogen, $R_{16}$ is $C_{1-4}$-alkylsulfonyl, $C_{1-4}$-alkylaminosulfonyl, phenylazo, sulfo or $-SO_2NH_2$, and the hydroxyl group in the benzo ring D is bonded in the o-position relative to the azo bridge on benzo ring D;

Symmetrical 1:2 cobalt complexes of azo dyes of the formulae

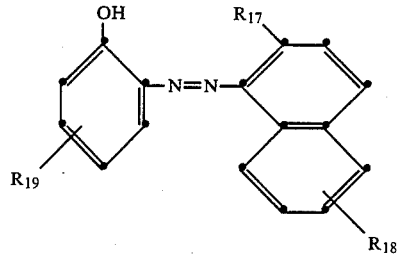

(12)

in which $R_{17}$ is an —OH or $NH_2$ group, $R_{18}$ is hydrogen or $C_{1-4}$-alkylaminosulfonyl, and $R_{19}$ is nitro or $C_{1-4}$-alkoxy-$C_{1-4}$-alkyleneaminosulfonyl;

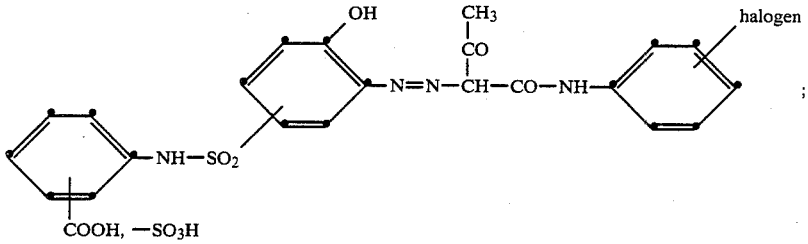

(13)

;

asymmetrical 1:2 metal complex dyes, such as 1:2 chromium complex dyes of azo dyes of the formulae

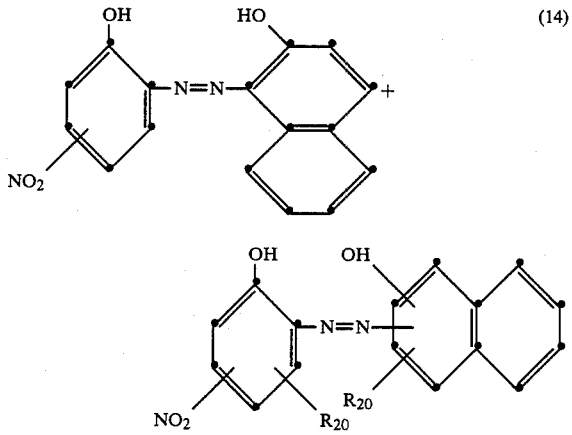

(14)

in which one $R_{20}$ is hydrogen while the other is sulfo;

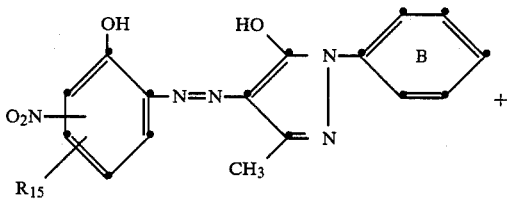

(15)

-continued

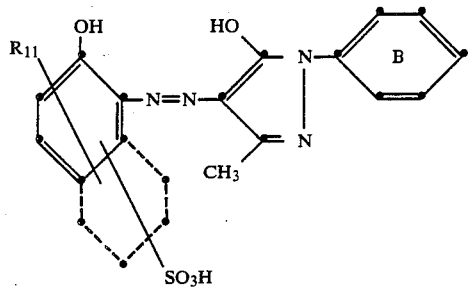

in which $R_{11}$ is as defined under the formula (9), $R_{15}$ is as defined under the formula (11) and phenyl rings B, independently of each other, can each contain the substituents given under the formula (6);

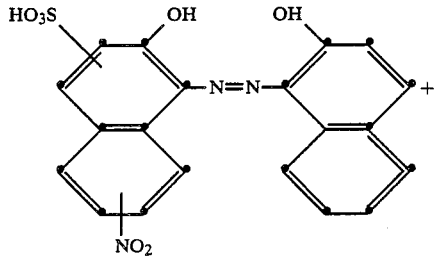

(16)

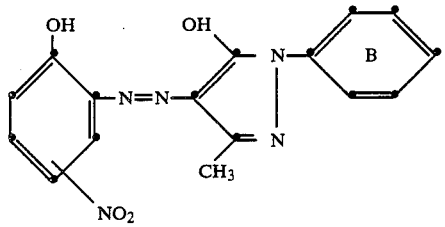

(17)

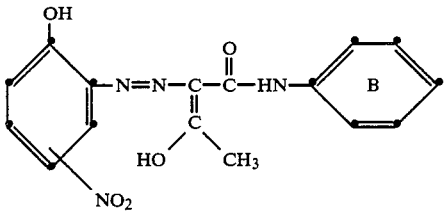

(18)

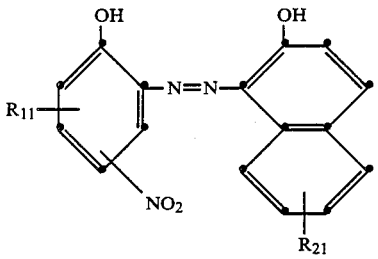

(19)

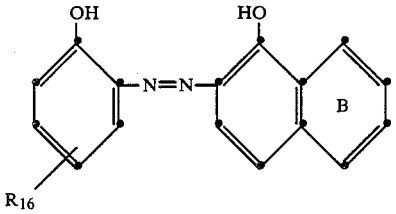

in which the phenyl ring B in the formulae (16), (17) and (19) can contain the substituents given under the formula (6), $R_{11}$ is as defined under the formula (9), $R_{21}$ is hydrogen, methoxycarbonylamino or acetylamino, and $R_{16}$ is as defined under the formula (11);

1:2 chromium complex dyes of azo dyes of the formulae (10)+(11);

1:2 chromium mixed complexes of azo dyes of the formulae (10) and (11);

(e) anthraquinone dyes of the formulae

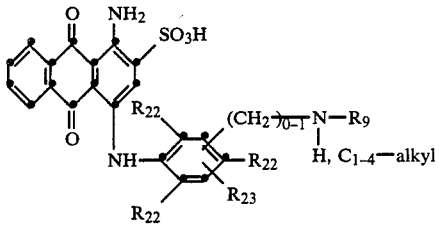

(20)

in which $R_9$ is as defined under the formula (6), the $R_{22}$s, independently of each other, are each hydrogen or $C_{1-4}$-alkyl, and $R_{23}$ is hydrogen, sulfo or the $—CH_2—NH—R_9$ radical;

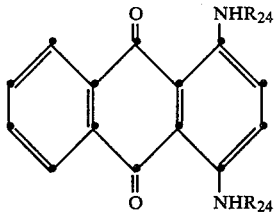

(21)

in which the $R_{24}$s, independently of each other, are each cyclohexyl or a diphenyl ether radical which can be substituted by sulfo or a $—CH_2NH—R_9$ radical in which $R_9$ is as defined under the formula (6); and

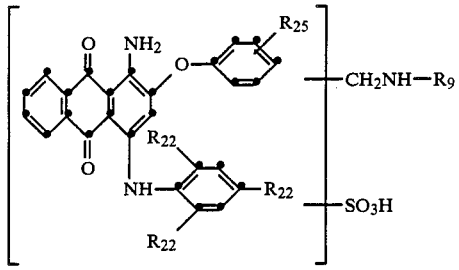

(22)

in which $R_9$ is as defined under the formula (6), $R_{22}$ is as defined under the formula (20), and $R_{25}$ is $C_{4-8}$-alkyl.

Examples of suitable fibre-reactive groups in the indicated formulae are groups of the type belonging to the aliphatic series, such as acryloyl, monochloroacryloyl, dichloroacryloyl, trichloroacryloyl, monobromoacryloyl, dibromoacryloyl, tribromoacryloyl, monochlorometacryloyl, dichlorometacryloyl, trichlorometacryloyl, monobromometacryloyl, dibromometacryloyl or tribromometacryloyl, such as —CO—CH=CH—Cl, —CO—CCl=$CH_2$, —CO—CH=CHBr, —COCBr=$CH_2$, —CO—CBr=CHBr, —CO—CCl=CH—$CH_3$, and also —CO—CCl=CH—COOH, —CO—CH=C-Cl—COOH, 3-chloropropionyl, 3-phenylsulfonylpropionyl, 3-methylsulfonylpropionyl, β-sulfatoethylaminosulfonyl, vinylsulfonyl, β-chloroethylsulfonyl, β-sulfatoethylsulfonyl, β-methylsulfonylethylsulfonyl, β-phenylsulfonylethylsulfonyl, 2-fluoro-2-chloro-3,3-difluorocyclobutane-1-carbonyl, 2,2,3,3-tetrafluorocyclobutane-1-carbonyl or -sulfonyl, β-(2,2,3,3-tetrafluorocyclobut-1-yl)-acryloyl, or α- or β-alkylsulfonylacryloyl or -arylsulfonylacryloyl, such as α- or β-methylsulfonylacryloyl.

Examples of reactive radicals which are particularly suitable for nylon are chloroacetyl, bromoacetyl, α,β-dichloropropionyl or -dibromopropionyl, α-chloroacryloyl or -bromoacryloyl, 2,4-difluoro-5-chloropyrimid-6-yl, 2,4,6-trifluoropyrimid-5-yl, 2,4-dichloro-5-methylsulfonylpyrimidin-6-yl, 2-fluoro-4-methyl-5-chloropyrimid-6-yl, 2,4-difluoro-5-methylsulfonylpyrimid-6-yl, 2,4-difluorotriazin-6-yl, and fluorotriazinyl radicals of the formula

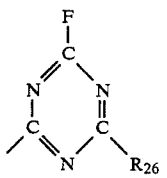

in which $R_{26}$ is a substituted or unsubstituted amino group or a free or etherified oxy or thio group, such as an $NH_2$ group, an amino group which is monosubstituted or disubstituted by $C_{1-4}$-alkyl radicals, a $C_{1-4}$-alkoxy group, a $C_{1-4}$-alkylmercapto group, arylamino, in particular phenylamino, or methyl-, methoxy-, chlorine- and especially sulfo-substituted phenylamino, phenoxy, monosulfophenoxy and disulfophenoxy and so on, as well as the corresponding chlorotriazinyl radicals.

The benzo rings drawn with broken lines in the formulae (11) and (15) mean that a benzo ring can be fused on to the phenol radical drawn in solid lines, so that the dyes optionally contain a phenol or naphthol radical.

Specific examples of the large number of anionic dyes which can be used in the process according to the invention are:

(a) triphenylmethane dyes, for example dyes of the formulae

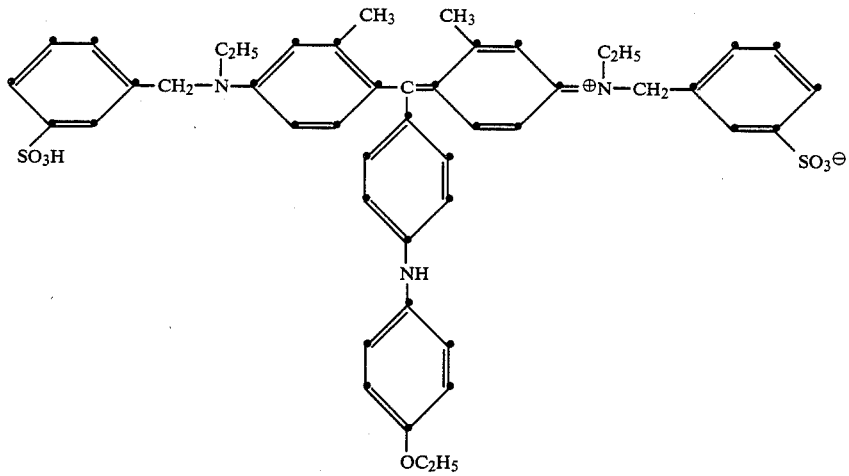

(23)

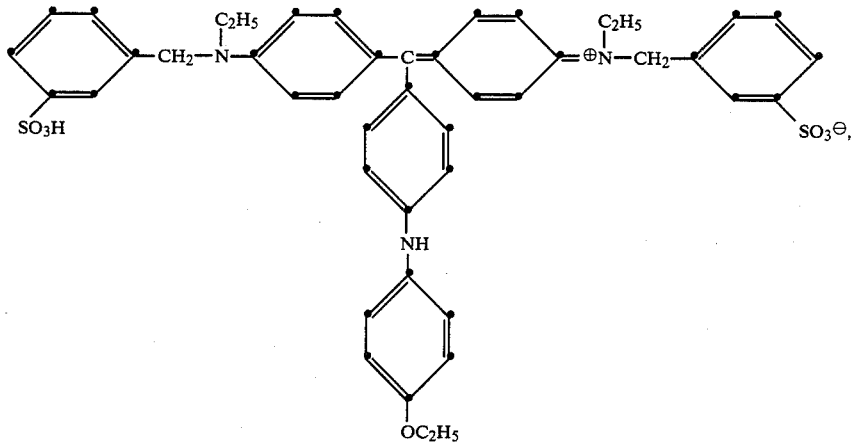

(24)

(b) monoazo and disazo dyes, for example those of the formulae

(25)
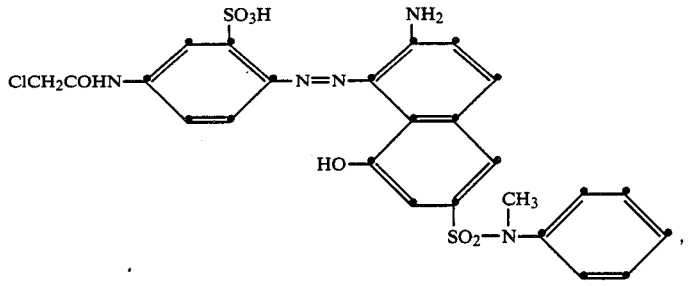
(26)
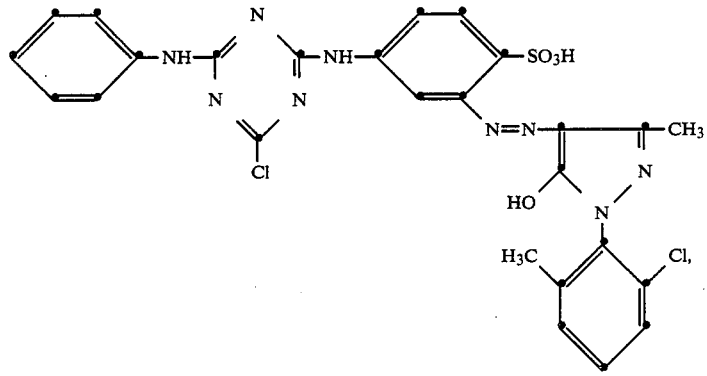
(26a)
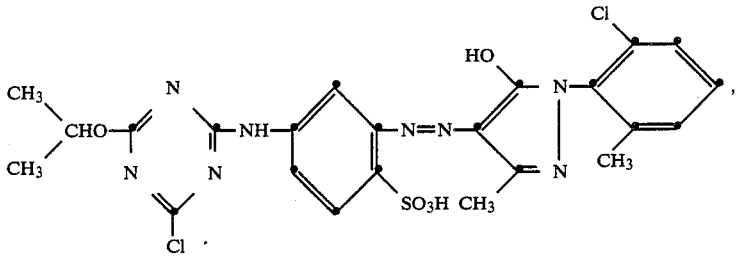
(27)
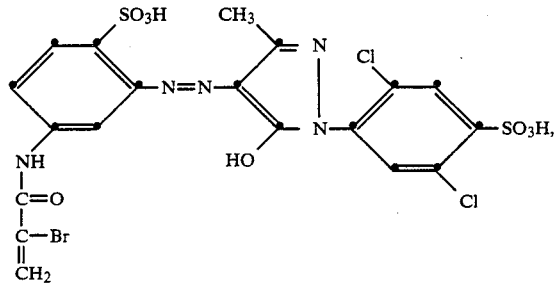
(28)
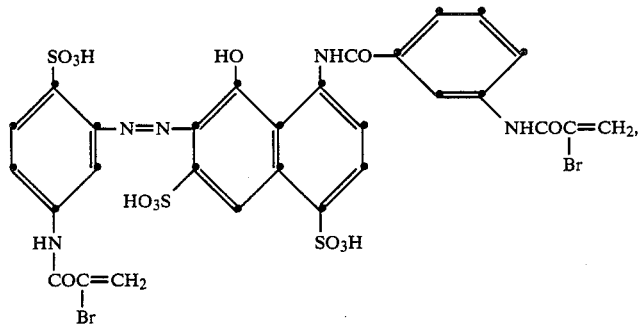

-continued
(29)
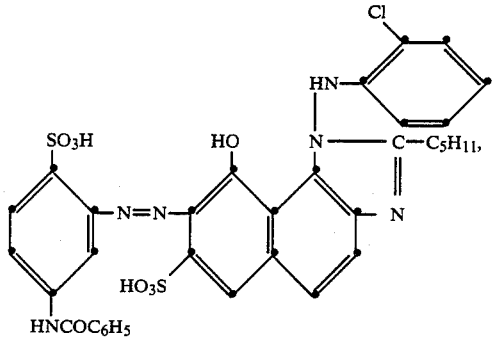
(30)
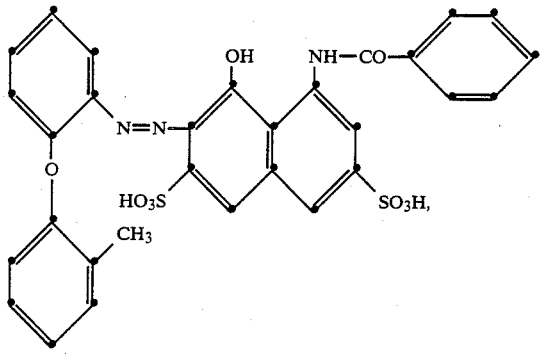
(31)
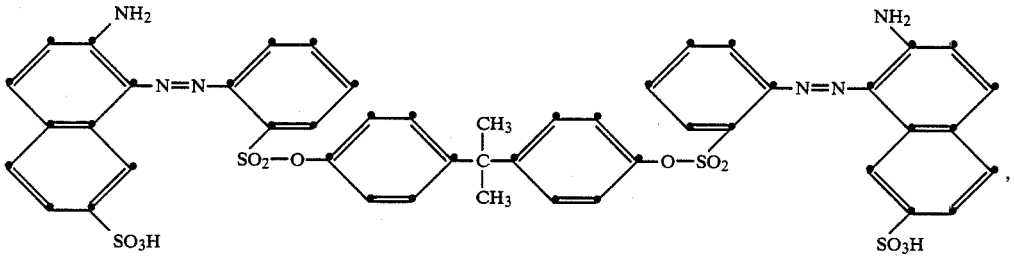
(32)
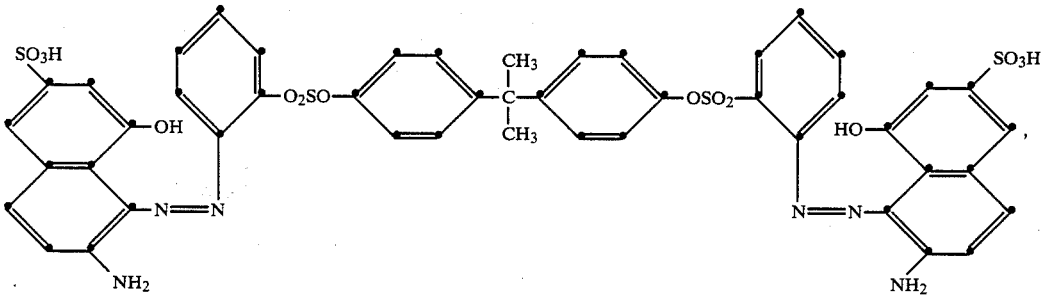
(c) 1:2 metal complex dyes, for example the 1:2 chromium complex of the azo and azomethine dye of the formulae
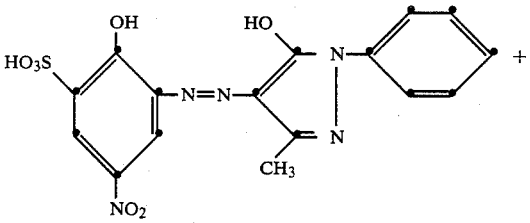
(33)
-continued
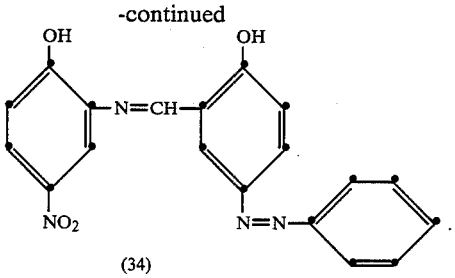
(34)
(d) 1:2 metal complex dyes, for example the dyes of the formulae

(35)
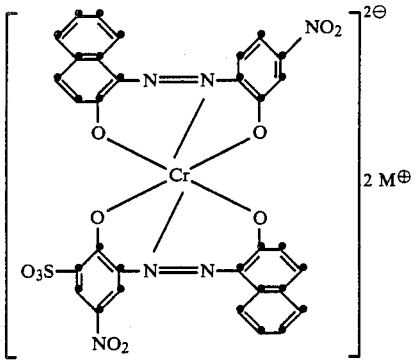
(36)
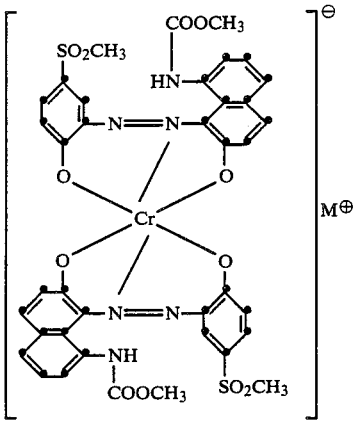
(37)
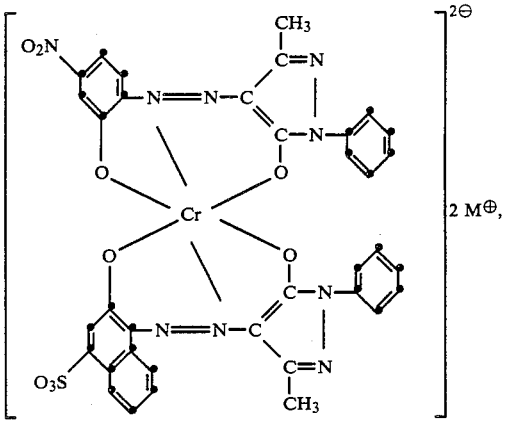
-continued
(38)
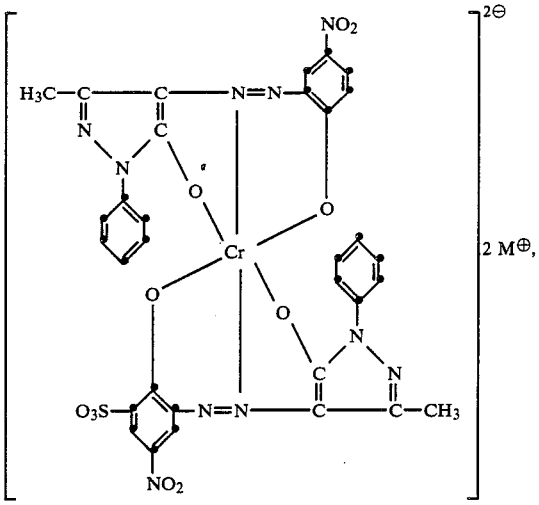
(39)
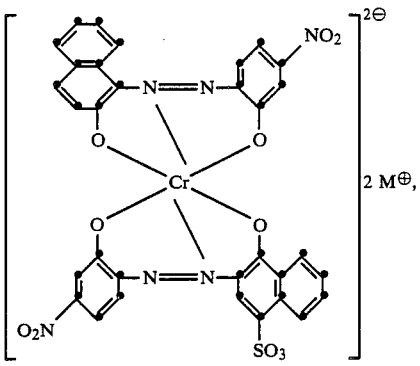
the 1:2 chromium complexes of azo dyes of the formulae
(40)
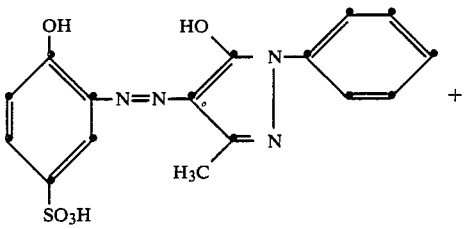
+
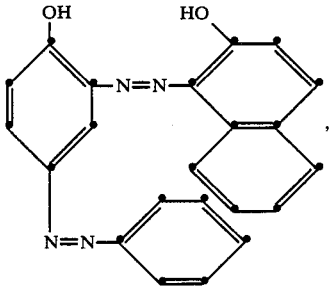

-continued
(41)
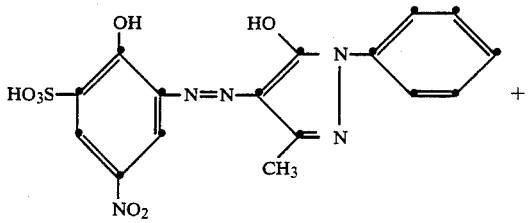
+
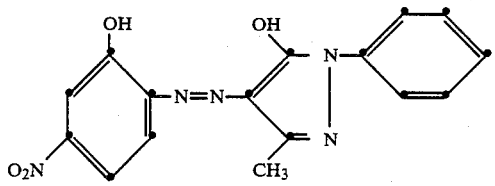
,
(42)
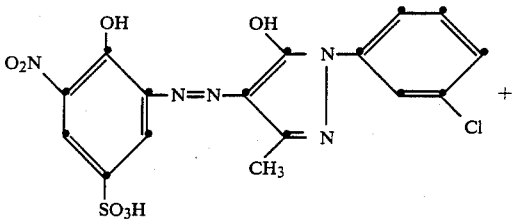
+
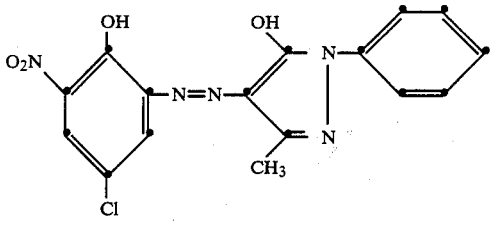
,
(43)
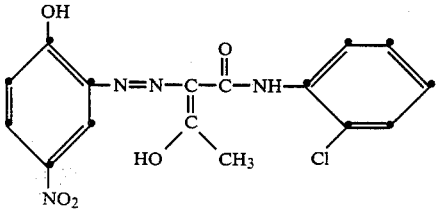
+
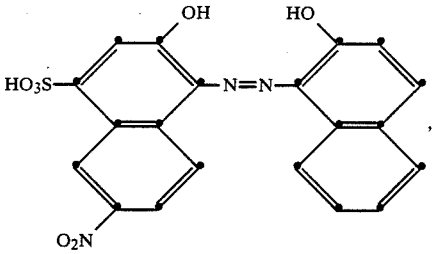
,
(44)
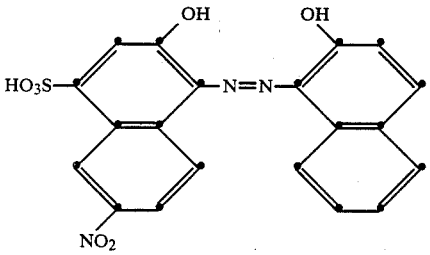
+
-continued
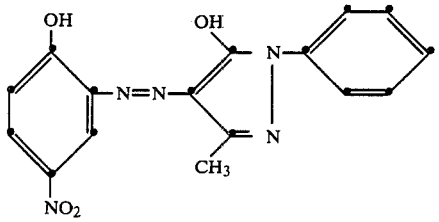
,
(45)
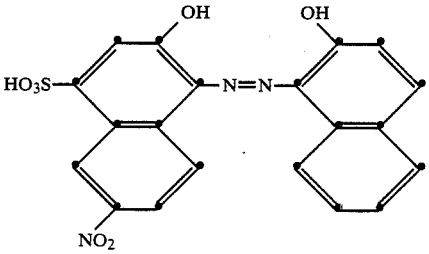
+
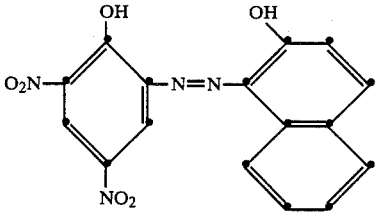
,
(46)
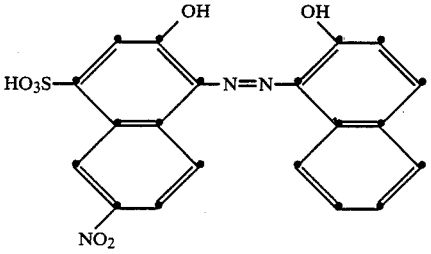
+
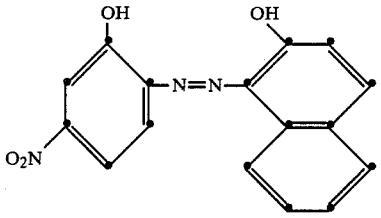
+
(47)
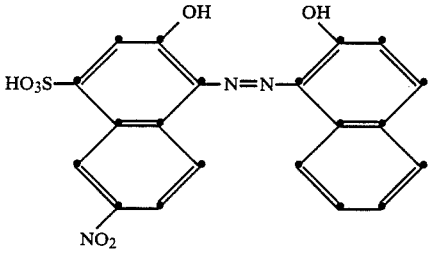
+

-continued
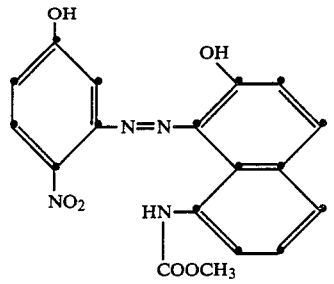
(48)
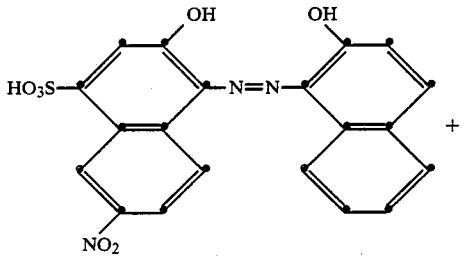
+
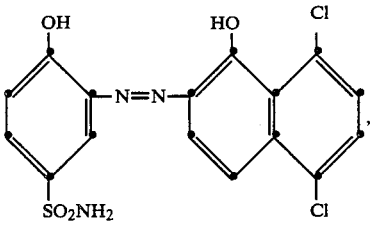
the symmetrical 1:2 chromium complexes of the azo dyes of the formulae
(49)
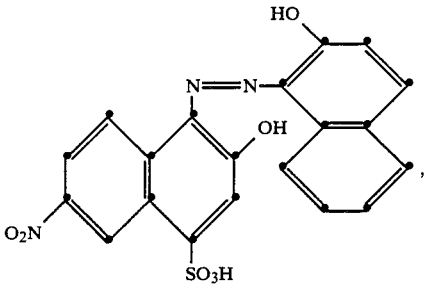
(50)
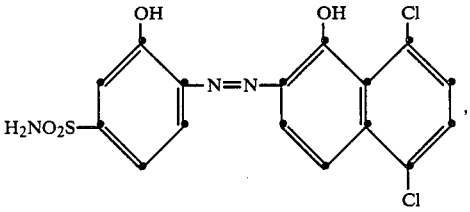
-continued
(51)
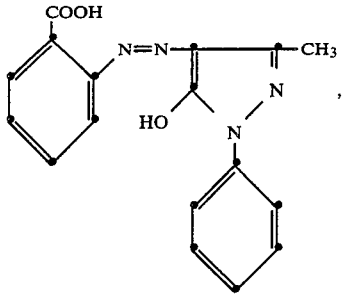
(52)
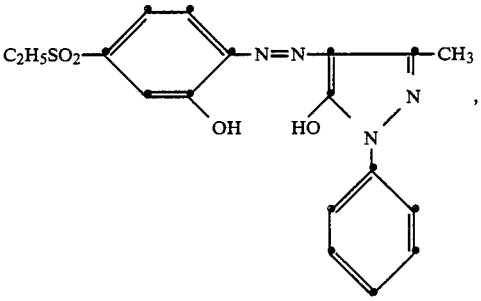
(53)
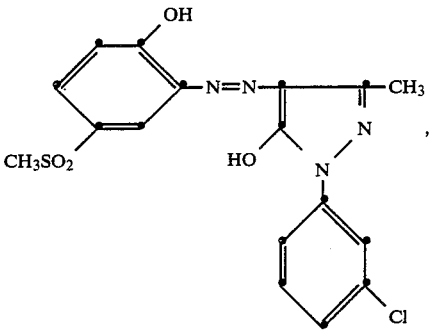
(54)
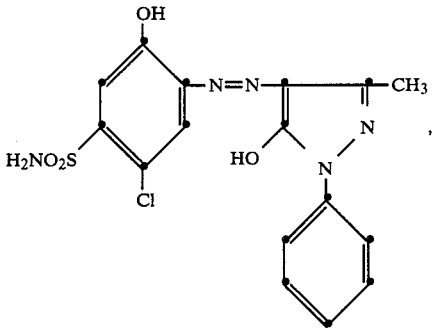
the symmetrical 1:2 cobalt complexes of the azo dyes of the formulae
(55)
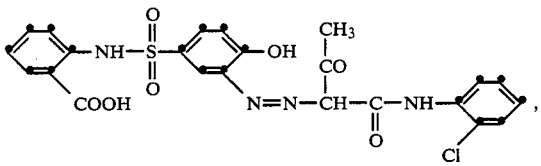

-continued (56)

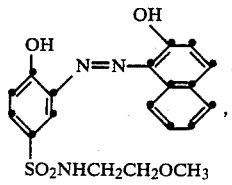

(57)

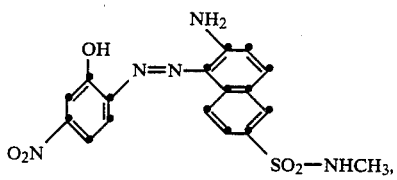

the 1:2 chromium complexes of the mixture of azo dyes of the formulae (58)

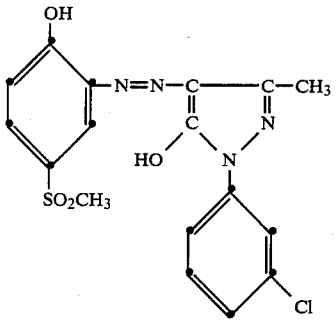

+

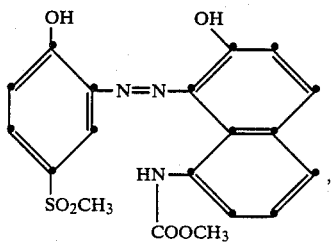

(e) anthraquinone dyes, for example those of the formulae (59)

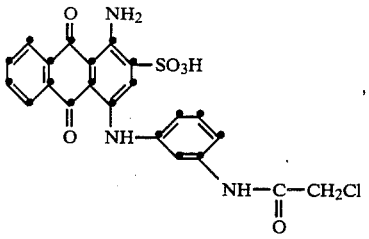

(60)

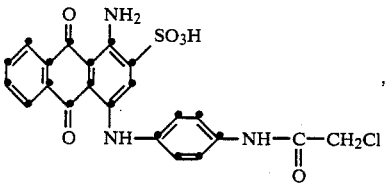

-continued (61)

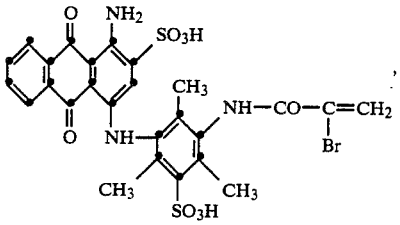

(62)

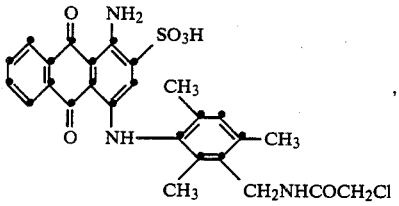

(62a)

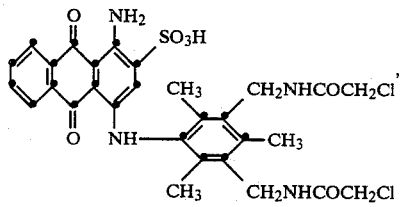

(63)

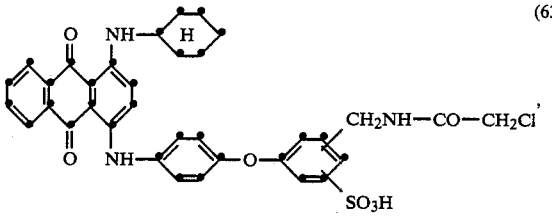

(64)

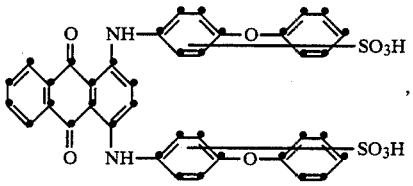

(65)

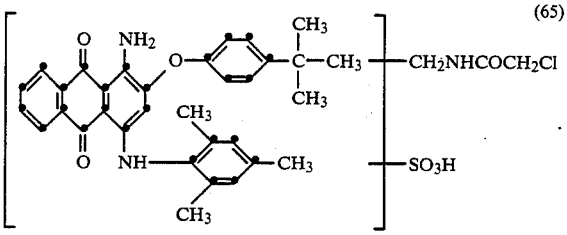

The sulfo-containing dyes used in the process according to the invention are either in the form of their free sulfonic acid or preferably in the form of the salts of that acid.

Examples of suitable salts are the alkali metal, alkaline earth metal and ammonium salts and the salts of organic amines. Examples are the sodium, lithium, potassium and ammonium salts and the salt of triethanolamine.

$M^{\oplus}$ in the formulae (35) to (39) indicated above is an alkali metal, alkaline earth metal or ammonium ion, for example the sodium, potassium, lithium or ammonium ion.

If dye mixtures are used in the process according to the invention these can be prepared by mixing the individual dyes. This mixing takes place for example in suitable mills, for example ball and pin mills, as well as in kneaders or mixers.

The dye mixtures, furthermore, can be prepared by spray-drying aqueous dye mixtures.

In the process according to the invention preference is given to the dyes of the formulae (62) to (65) and to the mixtures of dyes of the formulae (23)+(24)+(30)+(39), (25)+(42), (26)+(26a)+(27), (31)+(38), (40)+(44), (41)+(54), (32)+(37)+(56), (35)+(39)+(53)+(57), (36)+(51)+(53), (43)+(45)+(46)+(47)+(49) and (51)+(55). The individual dyes and the dye mixtures are distinguished by excellent compatibility, permitting the dyeing of virtually all shades for synthetic polyamide material.

Suitable radicals R, R' and R'' in the formulae (1), (2) and (3), independently of one another, are each alkyl or alkenyl radicals having 12 to 22, preferably 16 to 22, carbon atoms. Specific examples are the n-dodecyl, myristyl, n-hexadecyl, n-heptadecyl, n-octadecyl, arachidyl, behenyl, dodecenyl, hexadecenyl, oleyl and octadecenyl radicals.

A suitable radical M in the formula (1) is hydrogen, alkali metals such as sodium or potassium, or, in particular, ammonium.

The radical Q and the anion $A^-$ in the formula (2) are derived from quaternising agents, Q being a substituted or unsubstituted alkyl radical. Examples of suitable quaternising agents of this type are chloroacetamide, ethyl bromide, ethylene chlorohydrin, ethylene bromohydrin, epichlorohydrin, epibromohydrin and in particular dimethyl sulfate.

The dyeing assistant mixture used in the process according to the invention preferably contains 5 to 70 parts of the compound of the formula (1), 15 to 60 parts of the compound of the formula (2) and 5 to 60 parts of the compound of the formula (3), based on 100 parts of the dyeing assistant mixture.

In a preferred version of the process, the dyeing assistant mixture used, in addition to the compounds of the formulae (1), (2) and (3), also contains an adduct of 60 to 100 parts of ethylene oxide on to one part of a $C_{15-20}$-alkenyl alcohol. Examples of a $C_{15-20}$-alkenyl alcohol are hexadecenyl, oleyl and octadecenyl alcohols. Preferably, 5 to 10 parts, in particular 7 to 9 parts, of the adduct are used per 100 parts of the dyeing assistant mixture.

The amount in which the dyeing assistant mixture consisting of the compound of the formula (1), (2) and (3) and, if desired, also the above adduct of ethylene oxide on a $C_{15-20}$-alkenyl alcohol are added to the dyebath vary between 0.5 and 2 percent by weight on weight of fibre. It is preferably used 1 percent by weight of dyeing assistant mixture on weight of fibre.

The dyebaths, as further additives, can contain organic acids, advantageously low aliphatic carboxylic acids, for example in particular acetic acid. The main purpose of the acids is to bring the liquors used according to the invention to the correct pH.

The dyeing liquor can also contain alkali metal salts, for example sodium acetate. They preferably contain per liter 2 g of sodium acetate.

The dyebaths, in addition to the dye and said dyeing assistant mixture, can also contain further customary additives, for example wetting and defoaming agents, deaerating agents and carriers.

The liquor ratio can be chosen within a wide range, mainly from 5:1 to 40:1, preferably 8:1 to 25:1.

The dyeing is effected from an aqueous liquor by the exhaust method, for example at temperatures between 95° and 130° C., preferably at the boil.

The dyeing generally takes 10 to 50 minutes at the final dyeing temperature.

The process according to the invention requires no special apparatus. It is possible to use conventional dyeing apparatus and machines, for example for loose stock, tops, hanks, wound packages, piece goods and carpets.

The mixture of dyeing assistants is advantageously admixed to the aqueous liquor containing the dye and is applied at the same time as the dye. It is also possible first to treat the goods with a mixture of dyeing assistants and then to carry out the dyeing in the same bath after the dye has been added. The fibre material is preferably put into a liquor which contains per liter 2 g of sodium acetate and—to establish pH 5.5–6—sufficient acetic acid and the dyeing assistant mixture and has a temperature of 30° to 70° C. The dye or mixture of dyes is then added, and the temperature of the dyebath is raised at a rate of 0.75 to 3° C. per minute, if appropriate with a temperature stop during the heating-up, and dyeing takes place within the specified temperature range, from 95° to 130° C., preferably for 10 to 50 minutes. At the end the bath is cooled down, and the dyed material is, as customary, rinsed and dried.

The synthetic polyamide fibre material which can be dyed according to the invention can consist of any known synthetic polyamide. The fibre material can be dyed at various stages in processing, for example in the form of loose stock, tops, yarn, piece goods or carpets.

Compared with the known methods for fibre material made of synthetic polyamides the process according to the invention in addition to those already mentioned, also has the following advantages. The material thus dyed under uniform dyeing conditions is distinguished by excellent reproducibility of the desired shade. The dyeings obtained are also distinguished by good all-round fastness properties, in particular good light and wet fastness properties, and they are dyed level irrespective of the chosen hue and even irrespective of the chosen mixture of different types of dye. A further significant advantage is that the dyes are virtually completely absorbed. At the end of the dyeing process the dyebaths are almost completely exhausted.

The compounds of the formulae (1), (2) and (3) are known.

The compounds of the formula (1) can be prepared by adding 2 to 14 moles of ethylene oxide on to aliphatic amines which have an alkyl or alkenyl radical of 12 to 22 carbon atoms, and converting the adduct into the acid ester and, if desired, converting the acid ester obtained into the alkali metal or ammonium salts. The compounds of the formula (2) are prepared by adding for example 20 to 50 moles of ethylene oxide on to aliphatic amines which have an alkyl or alkenyl radical of 12 to 22 carbon atoms, and converting the adduct with one of the abovementioned quaternising agents into the compound of the formula (2).

The compounds of the formula (3) are prepared by adding 80 to 140 moles of ethylene oxide on to a compound of the formula

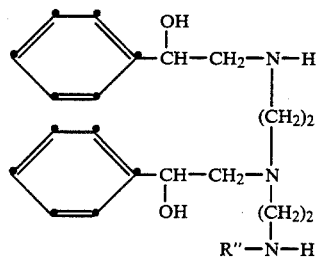

(66)

in which R'' is as defined under the formula (3).

The amines which are required as starting materials for preparing the compounds of the formulae (1) and (2) can have saturated or unsaturated, branched or unbranched hydrocarbon radicals of 12 to 22, preferably 16 to 22, carbon atoms. The amines can be single compounds or mixtures. The amine mixtures used are preferably of the type formed in the conversion of natural fats or oils, for example tallow fat or soya or coconut oil, into the corresponding amines. Specific examples of amines are dodecylamine, hexadecylamine, octadecylamine, arachidylamine, behenylamine and octadecenylamine. Tallowamine is preferred. It constitutes a mixture of 30% of hexadecylamine, 25% of octadecylamine and 45% of octadecenylamine.

Both the addition of ethylene oxide and the esterification can be carried out using methods known per se. The esterification can be performed using sulfuric acid or its functional derivatives, for example chlorosulfonic acid or in particular sulfamic acid.

The esterification is generally carried out by simply mixing the reactants while heating them, advantageously to a temperature between 50° and 100° C. The free acids can then be converted into the alkali metal or ammonium salts by adding, in conventional manner, bases, for example ammonia, sodium hydroxide or potassium hydroxide.

The following examples serve to illustrate the invention. In these examples, parts and percentages are by weight. The temperatures are given in degrees Centigrade. The parts by weight relate to the parts by volume as the gram relates to the cubic centimeter.

Dyeing assistant mixture $A_1$ mentioned in the following examples has the following composition: 14.6 parts of the anionic compound of the formula

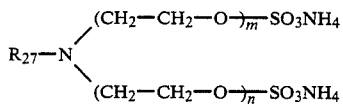

(67)

$R_{27}$=hydrocarbon radical of tallowamine; m+n=8;

21.3 parts of the quaternary compound of the formula

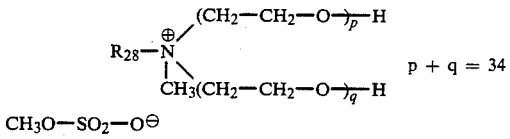

(68)

$R_{28}$=$C_{20-22}$-hydrocarbon radical;

7.7 parts of the reaction product between oleyl alcohol and 80 moles of ethylene oxide;

7.0 parts of the compound of the formula

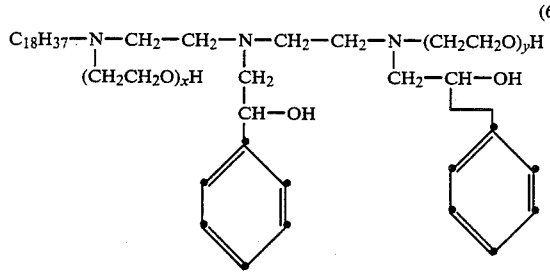

(69)

x + y = about 100 as well as 49.4 parts of water.

Dyeing assistant mixture $A_2$ referred to in the following examples has the following composition:

15.2 parts of the anionic compound of the formula (67), 21.3 parts of the quaternary compound of the formula (68), 7.7 parts of the reaction product between oleyl alcohol and 80 moles of ethylene oxide, 12.6 parts of the compound of the formula (69) and 43.2 parts of water.

Dyeing assistant mixture $A_3$ referred to in the following examples has the following composition:

12.6 parts of the anionic compound of the formula (67), 21.3 parts of the quaternary compound of the formula (68), 7.7 parts of the reaction product between oleyl alcohol and 80 moles of ethylene oxide, 10.0 parts of the compound of the formula (69) and 48.4 parts of water.

Dyeing assistant mixture $A_4$ referred to in the following examples has the following composition:

15.2 parts of the anionic compound of the formula (67), 21.3 parts of the quaternary compound of the formula (68), 7.7 parts of the reaction product between oleyl alcohol and 80 moles of ethylene oxide, 31 parts of the compound of the formula (69) and 24.8 parts of water.

EXAMPLE 1

75 g of texturised nylon 66 jersey are entered at 40° C. into a laboratory dyeing apparatus whose dyeing liquor contains 1.5 liters of water, 0.12 ml/l 80% strength acetic acid, 2 g/l sodium acetate, 0.25 g/l sodium sulfate and 0.75 g of dyeing assistant mixture $A_3$. After 10 minutes, 0.17 g of the dye of the formula

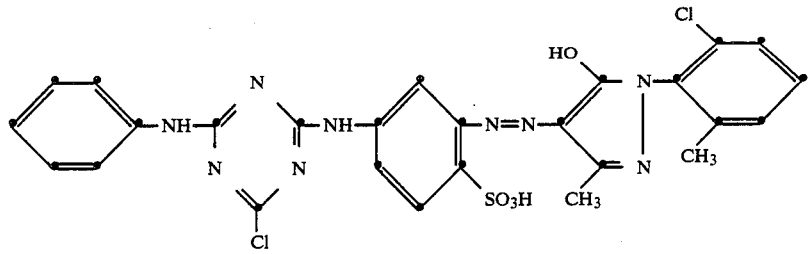

0.07 g of the dye of the formula

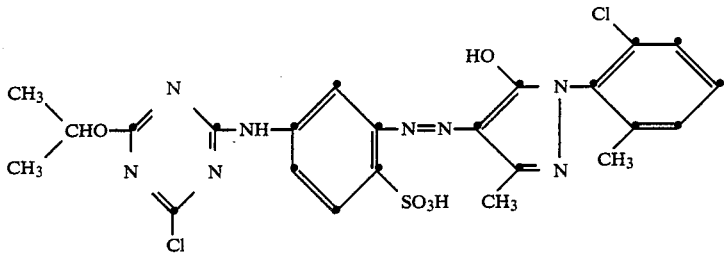

0.04 g of the dye of the formula

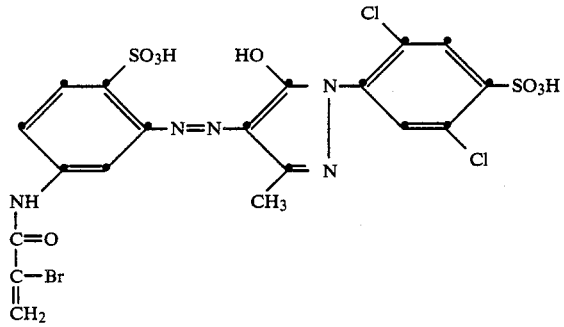

0.2 g of the dye of the formula

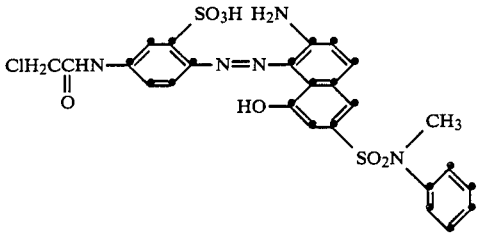

0.15 g of the dye of the formula

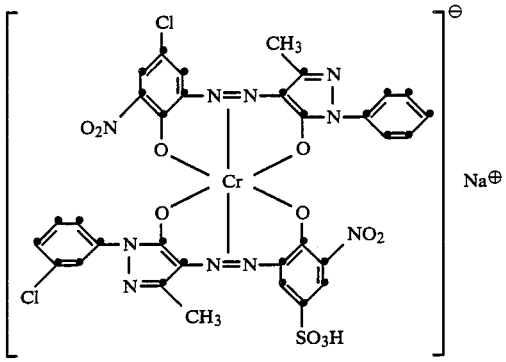

and 0.2 g of the dye of the formula

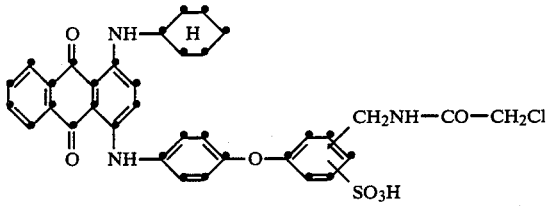

are added. The dyeing liquor is raised to 98° C. in the course of 45 minutes, and dyeing takes place at this temperature for 30 minutes. The dyebath is then cooled down, and the texturised nylon 66 jersey is rinsed and dried. The result is a brown dyeing on the texturised nylon 66 jersey. The degree of exhaustion is 98%. The dyebath pH is 5.7 at the start and 5.9 at the end.

EXAMPLE 2

75 g of texturised nylon 66 jersey are entered at 40° C. into a laboratory dyeing apparatus whose dyeing liquor contains 1.5 liters of water, 0.12 ml/l 80% strength acetic acid, 2 g/l sodium acetate, 0.5 g/l sodium sulfate and 0.75 g of dyeing assistant mixture $A_1$. After 10 minutes, 0.005 g of the 1:2 cobalt complex of the dye of the formula

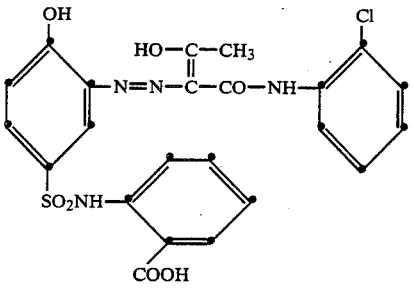
0.005 g of the 1:2 chromium complex of the dye of the formula
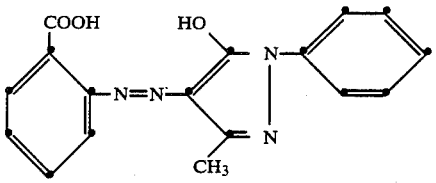
0.007 g of the dye of the formula
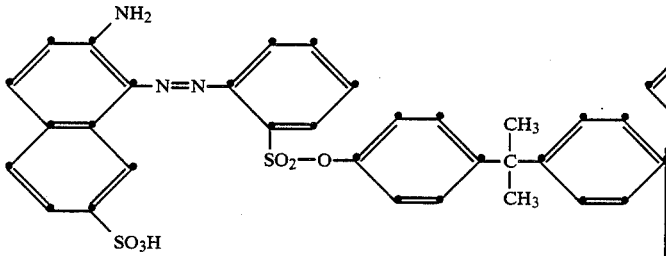
0.02 g of the dye of the formula
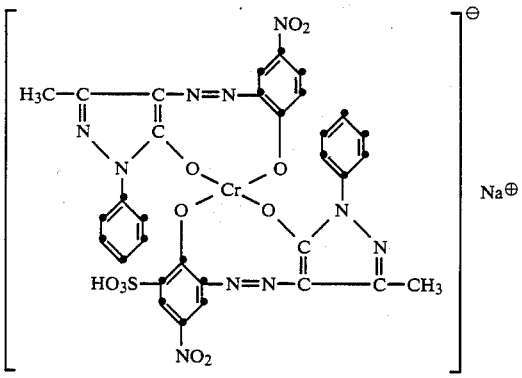
0.01 g of the dye of the formula
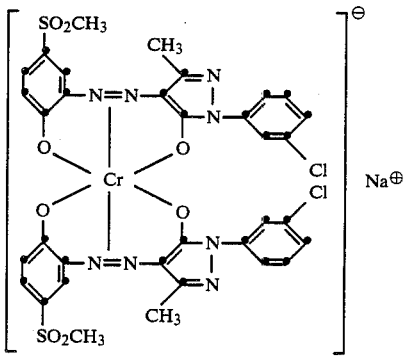
0.05 g of the dye of the formula
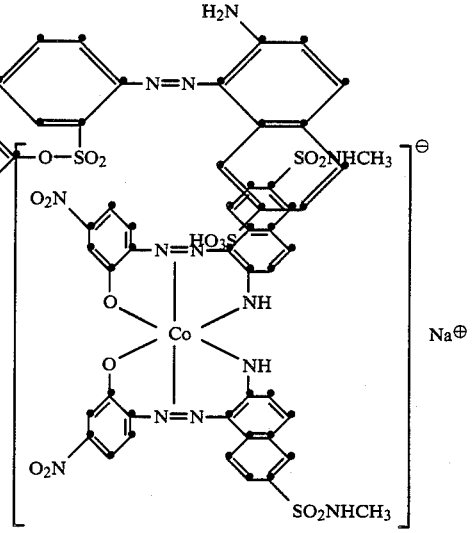
0.05 g of the dye of the formula
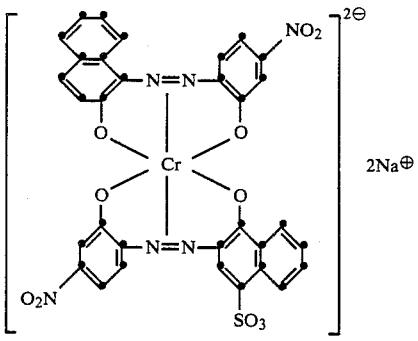
0.05 g of the dye of the formula

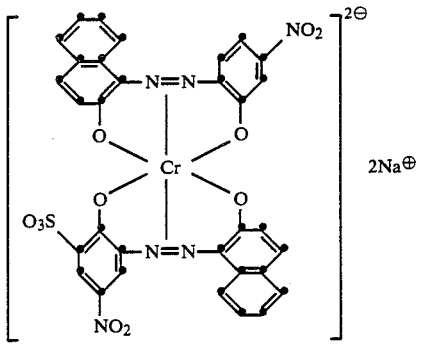

are added. The dyeing liquor is raised to 98° C. in the course of 45 minutes, and dyeing takes place at this temperature for 30 minutes. The dyebath is then cooled down, and the texturised nylon 66 jersey is rinsed and dried. The result is a brown dyeing on the texturised nylon 66 jersey. The degree of exhaustion is 99%. The dyebath pH is 5.7 at the start and 5.9 at the end.

EXAMPLE 3

In a circulating liquor dyeing machine, 700 g of nylon 66 spun yarn are wetted out at 40° in 11 liters of water. 0.12 ml/l 80% strength acetic acid, 2 g/l sodium acetate and 7 g of dyeing assistant mixture $A_1$ are then added. After 10 minutes, 2.2 g of the dye of the formula

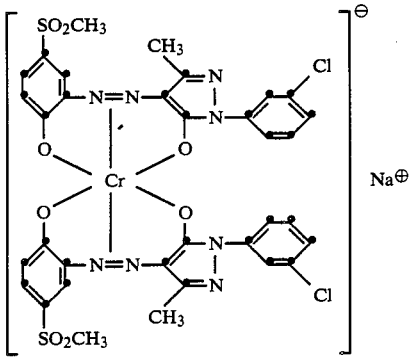

1 g of the dye of the formula

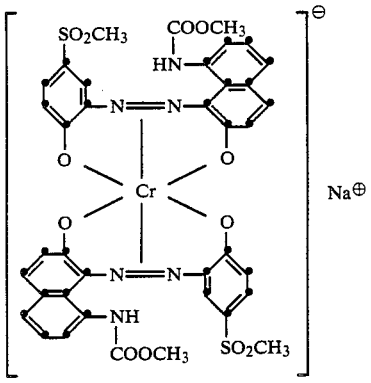

0.13 g of the dye of the formula

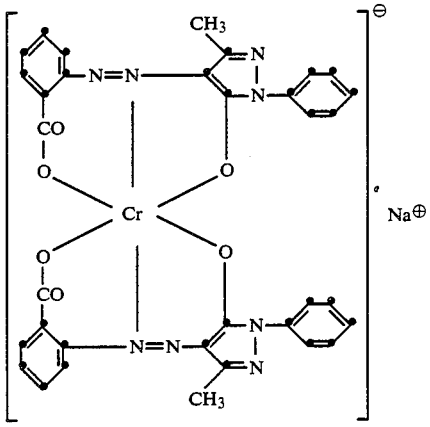

0.55 g of the 1:2 cobalt complex of the dye of the formula

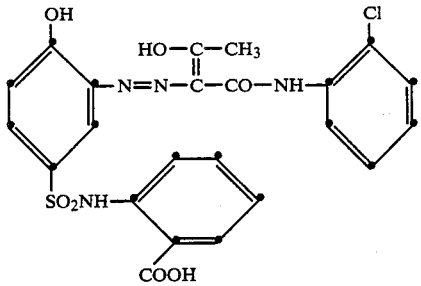

and 0.6 g of the 1:2 chromium complex of the dye of the formula

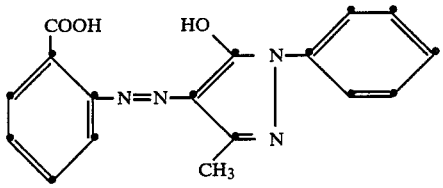

are added. The dyeing liquor, whose direction of circulation is changed at regular intervals, is raised to 98° C. in the course of 45 minutes, and dyeing takes place at this temperature for 30 minutes. The dyebath is then cooled down, and the nylon 66 spun yarn is rinsed and dried. The result is a brown dyeing on the nylon 66 spun yarn. The degree of exhaustion is 97%. The dyebath pH is 5.7 at the start and 5.9 towards the end.

EXAMPLE 4

In a circulating liquor dyeing machine, 700 g of loose nylon 6 fibre are wetted out at 40° C. in 11 liters of water. 0.12 ml/l 80% strength acetic acid, 2 g/l sodium acetate and 7 g of dyeing assistant mixture $A_1$ are then added. After 10 minutes, 0.05 g of the 1:2 cobalt complex of the dye of the formula

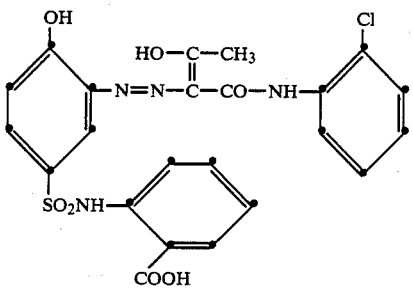
0.05 g of the 1:2 chromium complex of the dye of the formula
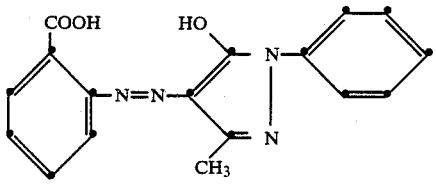
0.07 g of the dye of the formula
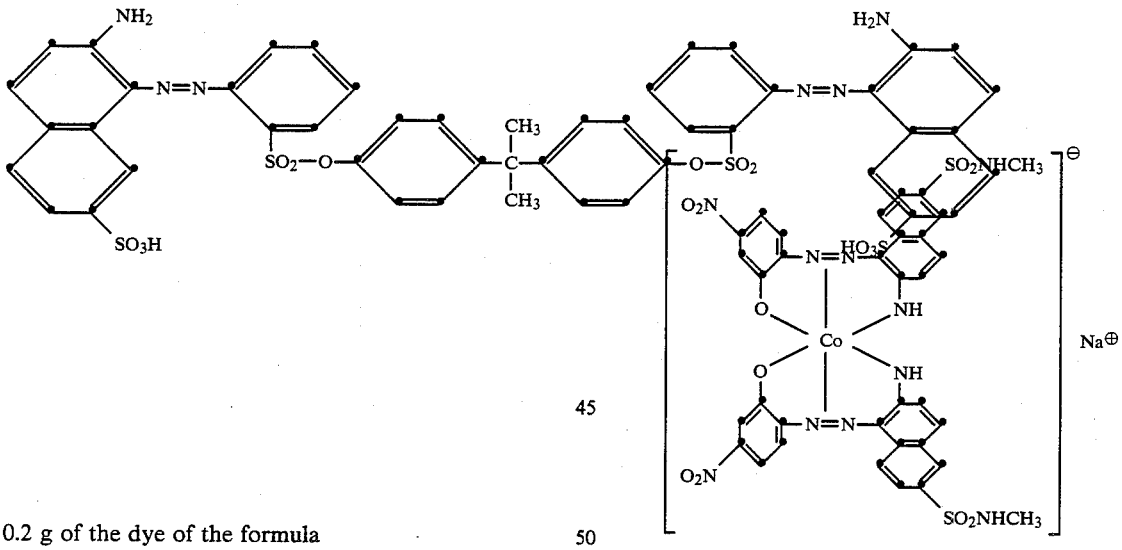
0.2 g of the dye of the formula
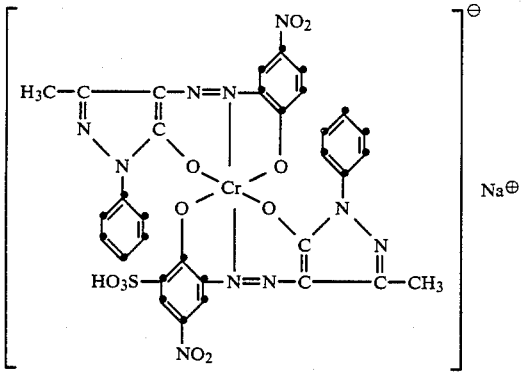
0.1 g of the dye of the formula
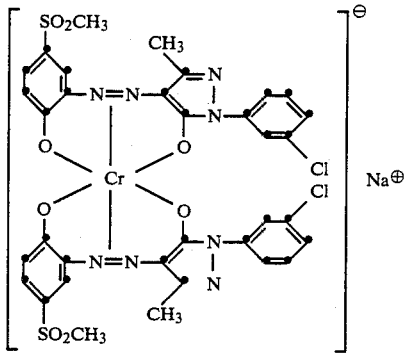
0.5 g of the dye of the formula
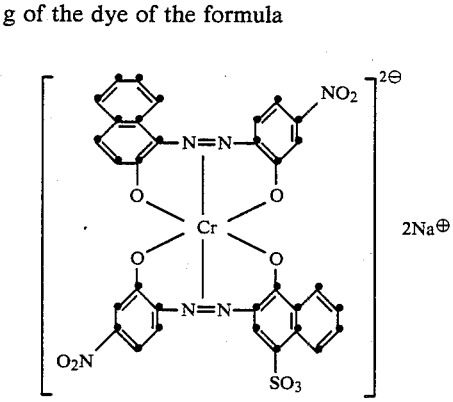
0.5 g of the dye of the formula
and 0.5 g of the dye of the formula

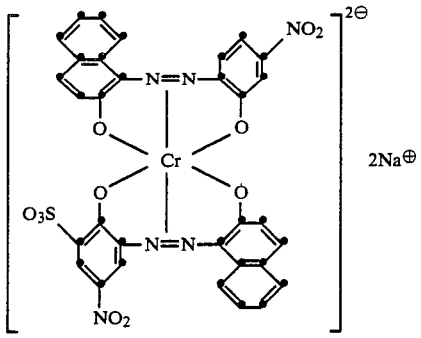

are added. The dyeing liquor, whose direction of circulation is changed at regular intervals, is raised to 98° C. in the course of 45 minutes, and dyeing takes place at this temperature for 30 minutes. The dyebath is then cooled down, and the loose nylon 6 fibre is rinsed and dried. The result is a grey dyeing on the loose nylon 6 fibre. The dyebath pH is 5.7 at the start and 5.9 towards the end. The degree of exhaustion is 99%.

The example is repeated, except that dyeing assistant mixture $A_1$ is replaced by the same amount of dyeing assistant mixture $A_2$ or $A_4$, likewise affording a grey dyeing having equally good properties.

EXAMPLE 5

In a circulating liquor dyeing machine, 700 g of loose nylon 6 fibre are wetted out at 40° C. in 11 liters of water. 0.12 ml/l 80% strength acetic acid, 2 g/l sodium acetate, 3 g/l sodium sulfate and 7 g of dyeing assistant mixture $A_2$ are then added. After 10 minutes, 6.9 g of the dye of the formula

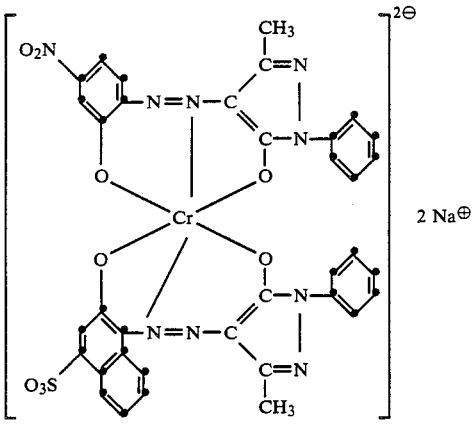

1 g of the dye of the formula

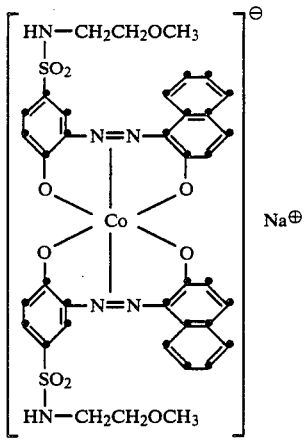

0.6 g of the dye of the formula

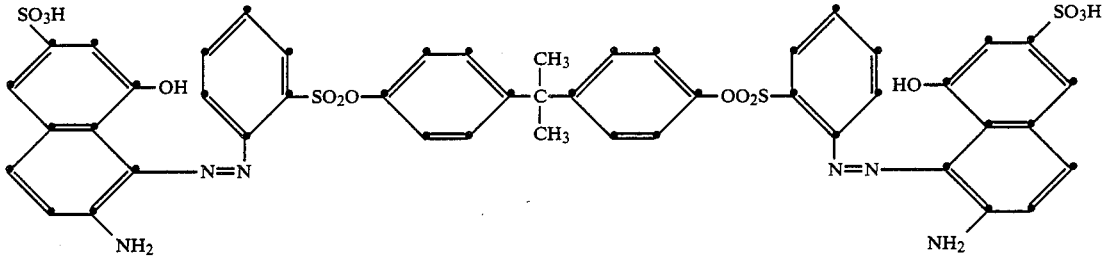

and 2.5 g of the dye of the formula

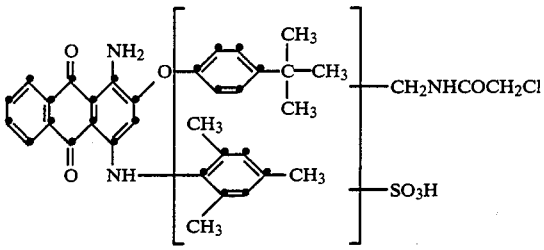

are added. The dyeing liquor, whose direction of circulation is changed at regular intervals, is raised to 98° C. in the course of 45 minutes, and dyeing takes place at this temperature for 30 minutes. The dyebath is then cooled down, and the loose nylon 6 fibre is rinsed and dried. The result is a red dyeing on the loose nylon 6 fibre. The dyebath pH is 5.7 at the start and 5.9 towards the end. The degree of exhaustion is 96%.

EXAMPLE 6

In a circulating liquor dyeing machine, 700 g of loose nylon 6 fibre are wetted out at 40° C. in 11 liters of water. 0.12 ml/l 80% strength acetic acid, 2 g/l sodium acetate and 7 g of dyeing assistant mixture $A_1$ are then added. After 10 minutes, 1.5 g of the dye of the formula

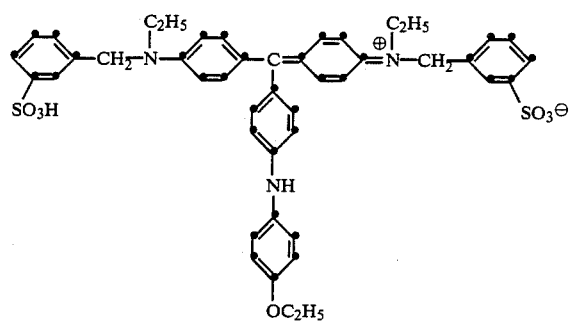

0.25 g of the dye of the formula

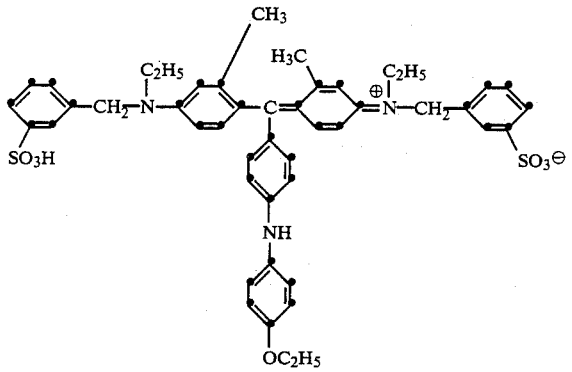

0.3 g of the dye of the formula

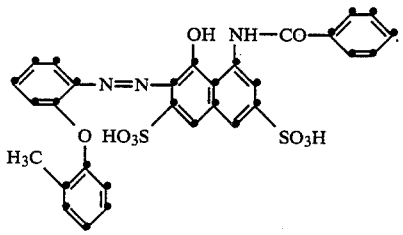

10 g of the dye of the formula

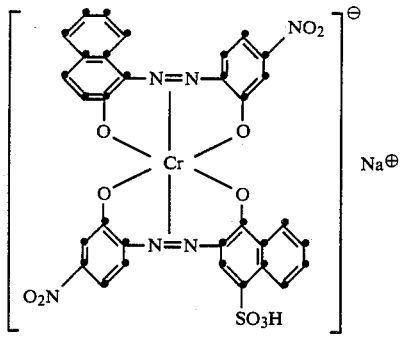

0.55 g of the 1:2 cobalt complex of the dye of the formula

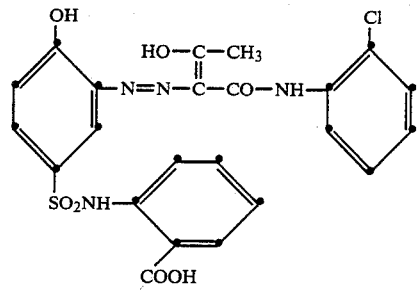

and 0.57 g of the 1:2 chromium complex of the dye of the formula

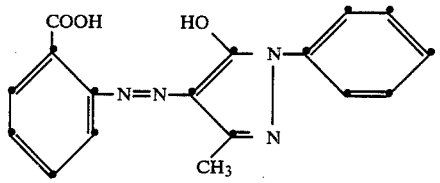

are added. The dyeing liquor, whose direction of circulation is changed at regular intervals, is raised to 120° C. in the course of 45 minutes, and dyeing takes place at this temperature for 10 minutes. The dyebath is then cooled down, and the loose nylon 6 fibre is rinsed and dried. The result is a blue dyeing on the loose nylon 6 fibre. The dyebath pH is 5.7 at the start and 5.9 towards the end. The degree of exhaustion is 96%.

EXAMPLE 7

In a circulating liqour dyeing machine, 700 g of loose nylon 6 fibre are wetted out at 40° C. in 11 liters of water. 0.12 ml/l 80% strength acetic acid, 2 g/l sodium acetate, 3 g/l sodium sulfate and 7 g of dyeing assistant mixture $A_4$ are then added. After 10 minutes, 1.2 g of the 1:2 cobalt complex of the dye of the formula

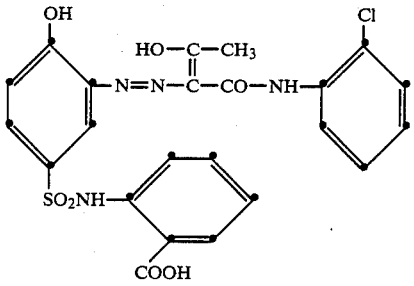

2.6 g of the 1:2 chromium complex of the dye of the formula

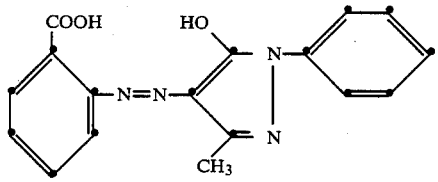

0.4 g of the dye of the formula

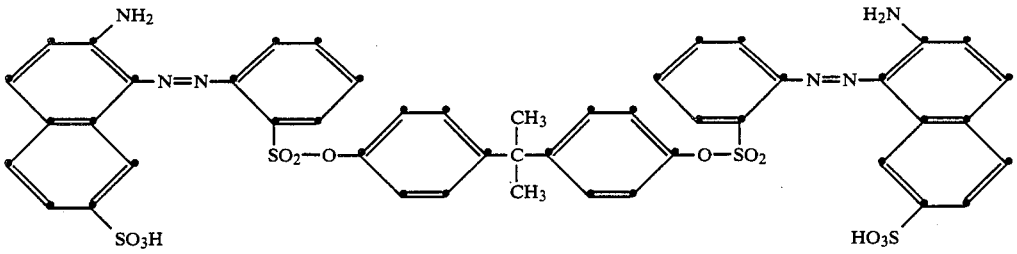

0.9 g of the dye of the formula

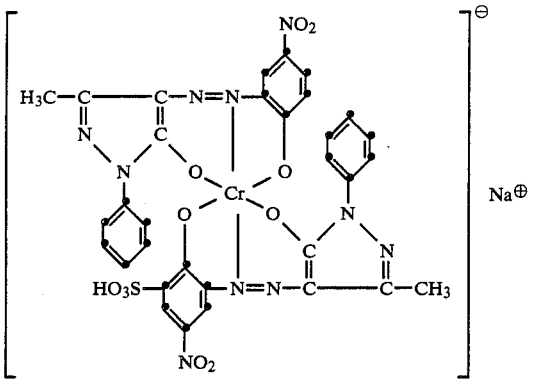

and 17.6 g of the dye of the formula

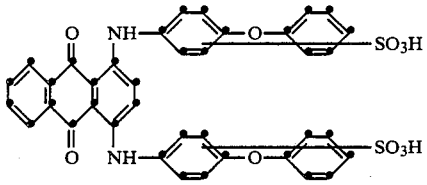

are added. The dyeing liquor, whose direction of circulation is changed at regular intervals, is raised to 98° C. in the course of 45 minutes, and dyeing takes place at this temperature for 30 minutes. The dyebath is then cooled down, and the loose nylon 6 fibre is rinsed and dried. The result is a green dyeing on the loose nylon 6 fibre. The dyebath pH is 5.7 at the start and 5.9 towards the end. The degree of exhaustion is 96%.

EXAMPLE 8

In a circulating liquor dyeing machine, 700 g of loose nylon 6 fibre are wetted out at 40° C. in 11 liters of water. 0.12 ml/l 80% strength acetic acid, 2 g/l sodium acetate, 3 g/l sodium sulfate and 7 g of dyeing assistant mixture $A_2$ are then added. After 10 minutes, 0.4 g of the 1:2 cobalt complex of the dye of the formula

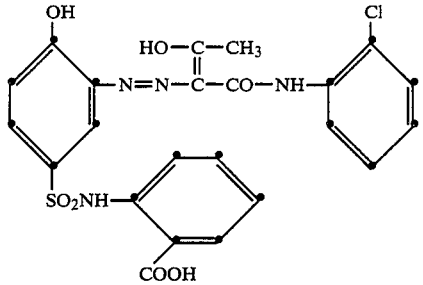

0.9 g of the 1:2 chromium complex of the dye of the formula

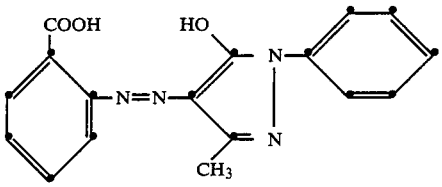

0.2 g of the dye of the formula

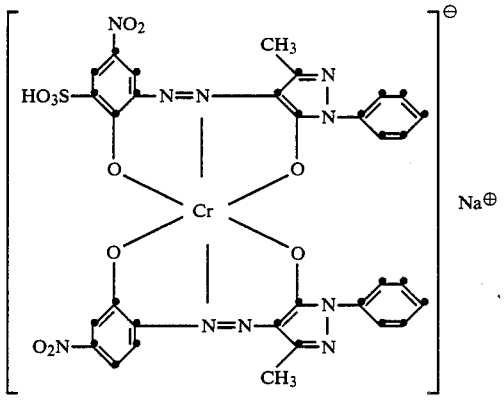

0.04 g of the dye of the formula

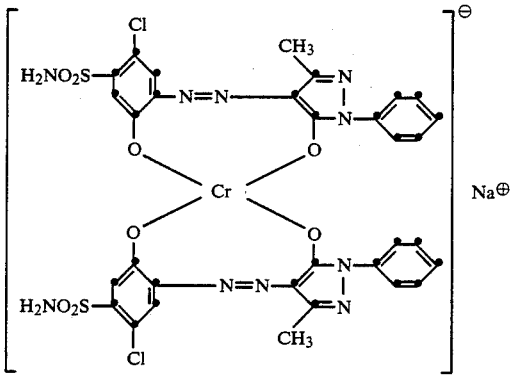

0.65 g of the dye of the formula

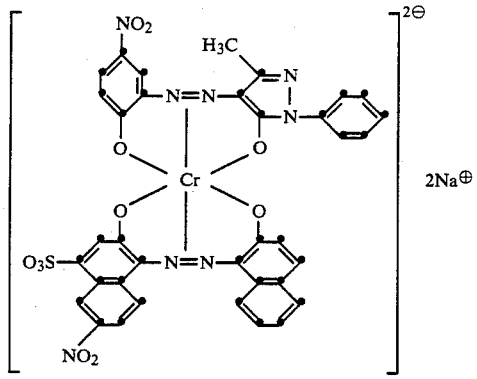

and 0.3 g of the dye of the formula

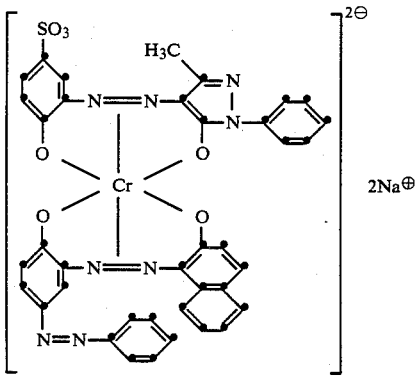

are added. The dyeing liquor, whose direction of circulation is changed at regular intervals, is raised to 98° C. in the course of 45 minutes, and dyeing takes place at this temperature for 30 minutes. The dyebath is then cooled down, and the loose nylon 6 fibre is rinsed and dried. The result is a beige dyeing on the loose nylon 6 fibre. The dyebath pH is 5.7 at the start and 5.9 towards the end. The degree of exhaustion is 98%.

EXAMPLE 9

In a circulating liquor dyeing machine, 700 g of loose nylon 6 fibre are wetted out at 40° C. in 11 liters of water. 0.12 ml/l 80% strength acetic acid, 2 g/l sodium acetate and 7 g of dyeing assistant mixture $A_1$ are then added. After 10 minutes, 6 g of the dye of the formula

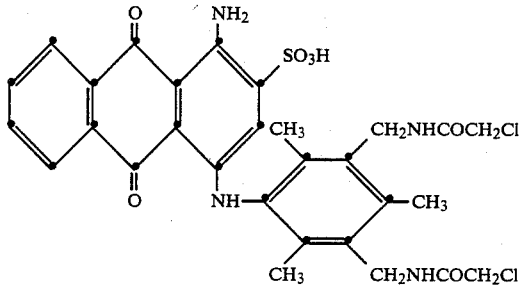

1.25 g of the dye of the formula

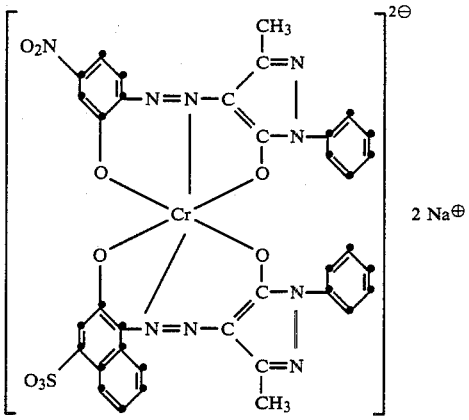

0.2 g of the dye of the formula

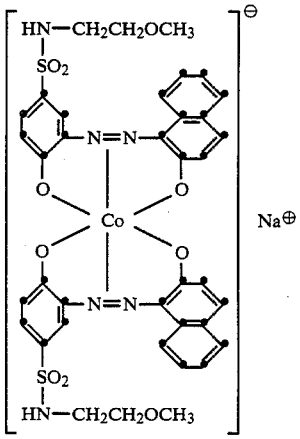

and 0.1 g of the dye of the formula

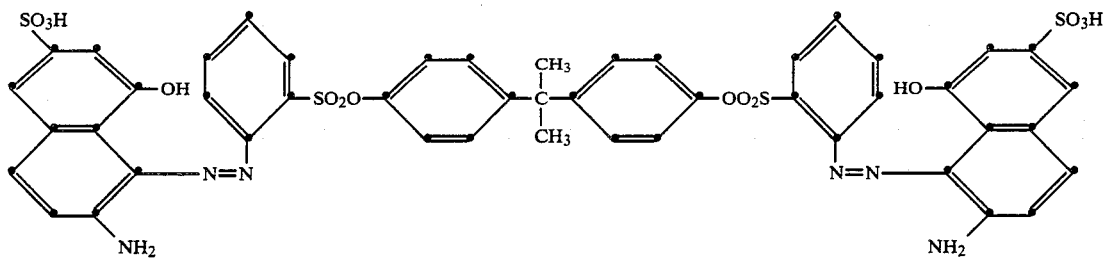

are added. The dyeing liquor, whose direction of circulation is changed at regular intervals, is raised to 120° C. in the course of 45 minutes, and dyeing takes place at this temperature for 10 minutes. The dyebath is then cooled down, and the loose nylon 6 fibre is rinsed and dried. The result is a blue dyeing on the loose nylon 6 fibre. The dyebath pH is 5.7 at the start and 5.9 towards the end. The degree of exhaustion is 97%.

EXAMPLE 10

In a circulating liquor dyeing machine, 700 g of loose nylon 6 fibre are wetted out at 40° C. in 11 liters of water. 0.12 ml/l 80% strength acetic acid, 2 g/l sodium acetate and 7 g of dyeing assistant mixture $A_1$ are then added. After 10 minutes, 8.4 g of the 1:2 mixed complexes of the
1:1 chromium complex of the dye of the formula

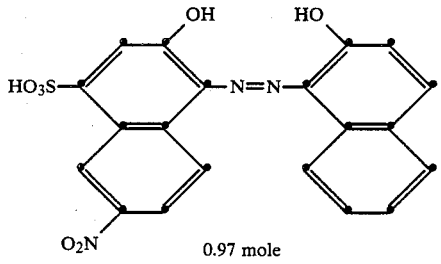

0.97 mole reacted with the metallisable dyes of the formulae

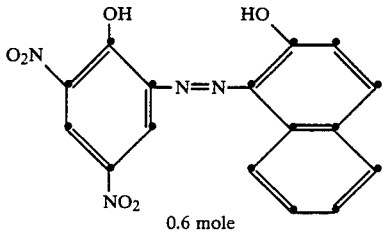

(a)

0.6 mole

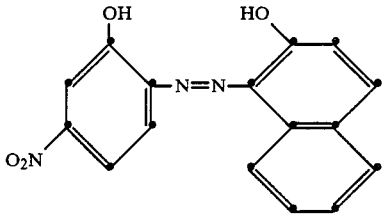

(b)

0.15 mole

-continued

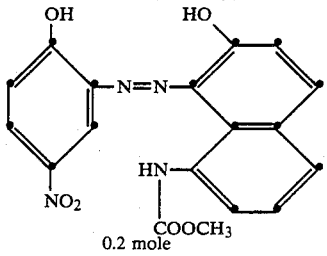

(c)

0.2 mole to give the corresponding 1:2 mix complexes, 8.4 g of the dye of the formula

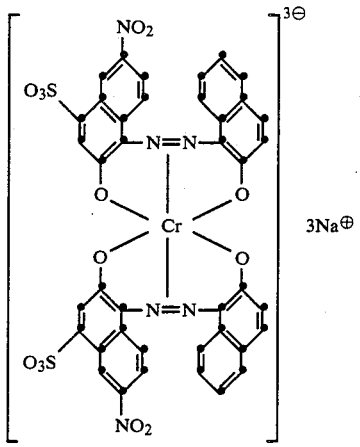

1 g of the dye of the formula

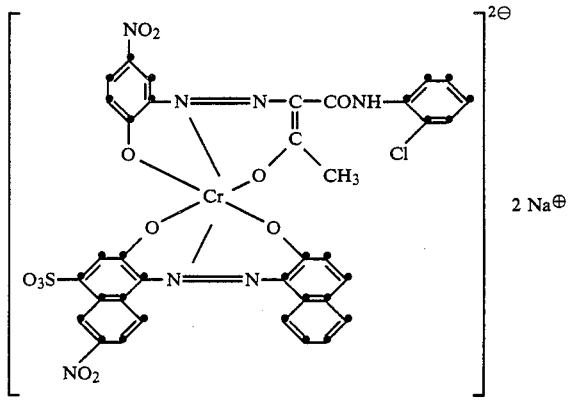

1.6 g of the dye of the formula

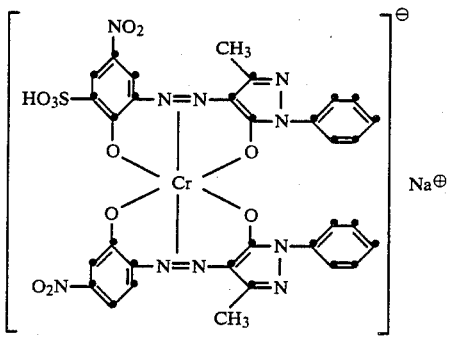

and 0.35 g of the dye of the formula

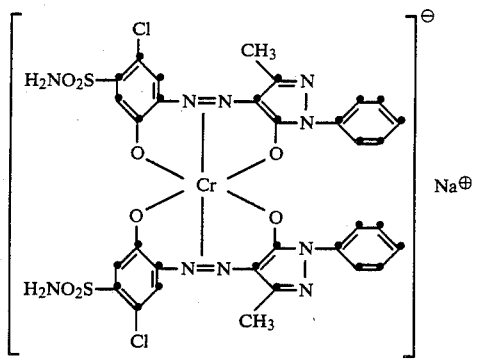

are added. The dyeing liquor, whose direction of circulation is changed at regular intervals, is raised to 120° C. in the course of 45 minutes, and dyeing takes place at this temperature for 10 minutes. The dyebath is then cooled down, and the loose nylon 6 fibre is rinsed and dried. The result is a black dyeing on the loose nylon 6 fibre. The dyebath pH is 5.7 at the start and 5.9 towards the end. The degree of exhaustion is 96%.

We claim:

1. In a process for dyeing synthetic polyamide fibre material with dyes or dye mixtures in the presence of a mixture of dyeing assistants, the improvement which comprises using for the dyeing of these materials an aqueous liquor which contains at least one anionic dye which, under the dyeing conditions of the process, at 1/1 standard depth exhausts to at least 95%, and a dyeing assistant mixture containing an anionic compound of the formula

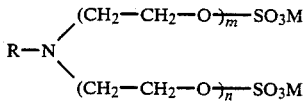

(1)

in which R is an alkyl or alkenyl radical having 12 to 22 carbon atoms, M is hydrogen, an alkali metal or ammonium, and m and n are integers such that m and n add up to 2 to 14, a quaternary compound of the formula

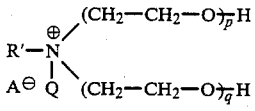

(2)

in which R′, independently of R, is defined in the same way as R, A is an anion, Q is a substituted or unsubstituted alkyl radical, and p and q are integers such that p and q add up to 20 to 50, and a nonionic compound of the formula

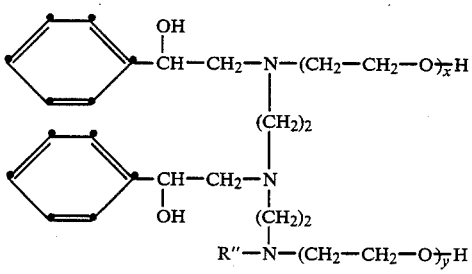

(3)

in which R″, independently of R, is defined in the same way as R, and x and y are integers such that x and y add up to 80 to 140, and which liquor can also contain an alkali metal salt and an organic acid and finishing the dyeing at pH 5 to 7 and at a temperature of 95° to 130° C.

2. A process according to claim 1, wherein dyeing is carried out at pH 5.5 to 6.

3. A process according to claim 1, wherein the anionic dyes used are triphenylmethane dyes having at least two sulfonic acid groups, monoazo and disazo dyes which are free of heavy metal but which each have one or more sulfonic acid groups and which can have one or more fibre-reactive groups, monoazo, disazo, azomethine and formazan dyes which contain heavy metals, and anthraquinone dyes.

4. A process according to claim 3, wherein the anionic dyes used are dyes or mixtures of dyes of the formulae (4) to (8)

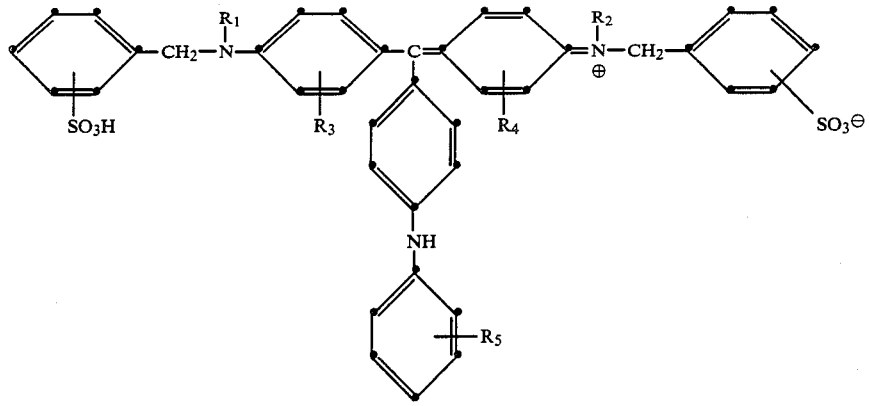

(4)

in which $R_1$ and $R_2$, independently of each other, are each $C_{1-4}$-alkyl, $R_3$ and $R_4$ are hydrogen or $C_{1-4}$-alkyl and $R_5$ is $C_{1-4}$-alkyl, $C_{1-4}$-alkoxy or hydrogen;

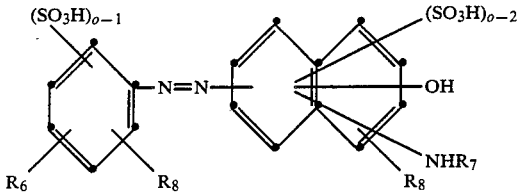

(5)

in which $R_6$ is a fibre-reactive group bonded via a —NH— group or benzoylamino, phenoxy, chlorophenoxy, dichlorophenoxy or methylphenoxy, $R_7$ is hydrogen, benzoyl, phenyl, $C_{1-4}$-alkyl, phenylsulfonyl, methylphenylsulfonyl or a fibre-reactive group which can be bonded via aminobenzoyl, and the $R_8$s, independently of each other, are each hydrogen or a phenylamino or N-phenyl-N-methylaminosulfonyl radical;

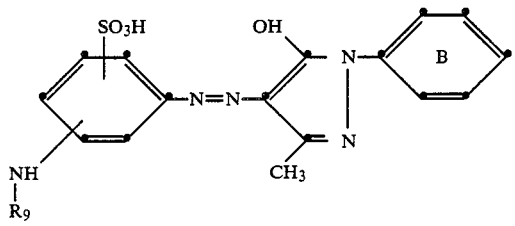

(6)

in which $R_9$ is fibre-reactive group and the phenyl ring B can be substituted by halogen, $C_{1-4}$-alkyl and sulfo;

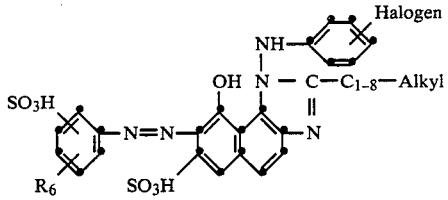

(7)

in which $R_6$ is as defined under the formula (5);

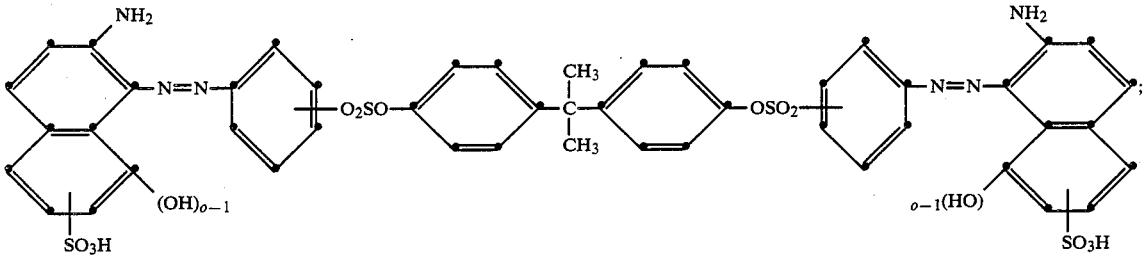

(8)

the 1:2 chromium metal complex dyes, of azo and azomethine dyes of the formula (9)

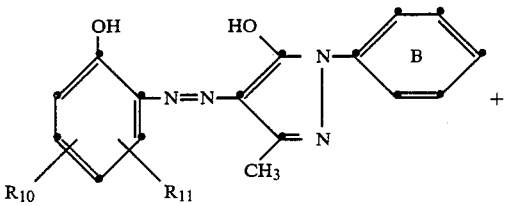

(9)

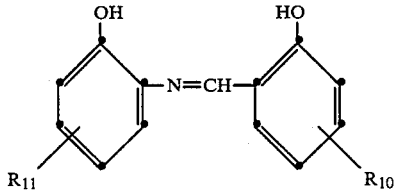

in which $R_{10}$ is hydrogen, sulfo or phenylazo, $R_{11}$ is hydrogen or nitro, and the phenyl ring B can contain the substituents given under the formula (6); symmetrical 1:2 chromium complex dyes of azo dyes of the formulae (10) and (11)

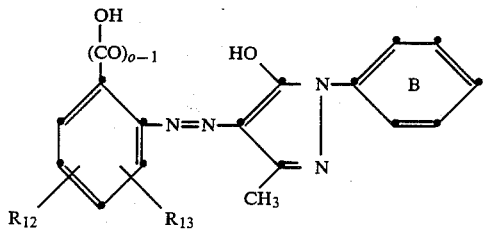

(10)

in which the phenyl ring B can contain the substituents given in the formula (6), and $R_{12}$ and $R_{13}$, independently of each other, are each hydrogen, nitro, sulfo, halogen, $C_{1-4}$-alkylsulfonyl, $C_{1-4}$-alkylaminosulfonyl or $—SO_2NH_2$;

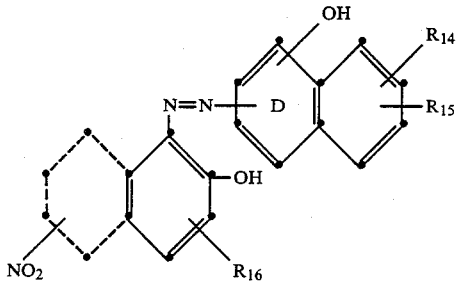

(11)

in which $R_{14}$ is hydrogen, $C_{1-4}$-alkoxycarbonylamino, benzoylamino, $C_{1-4}$-alkylsulfonylamino, phenylsulfonylamino, methylphenylsulfonylamino or halogen, $R_{15}$ is hydrogen or halogen, $R_{16}$ is $C_{1-4}$-alkylsulfonyl, $C_{1-4}$-alkylaminosulfonyl, phenylazo, sulfo or $—SO_2NH_2$, and the hydroxyl group in the benzo ring D is bonded in the o-position relative to the azo bridge on benzo ring D;

symmetrical 1:2 cobalt complexes of azo dyes of the formulae (12) and (13)

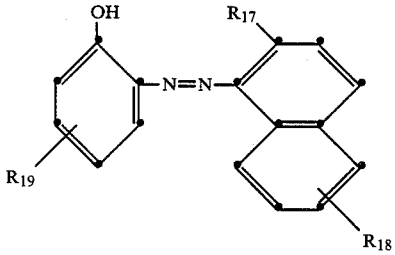

(12)

in which $R_{17}$ is an —OH or $NH_2$ group, $R_{18}$ is hydrogen or $C_{1-4}$-alkylaminosulfonyl, and $R_{19}$ is nitro or $C_{1-4}$-alkoxy-$C_{1-4}$-alkyleneaminosulfonyl;

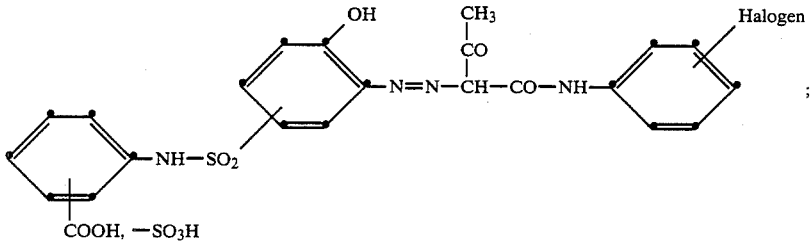

(13)

asymmetrical chromium complex dyes of azo dyes of the formulae (14) to (19)

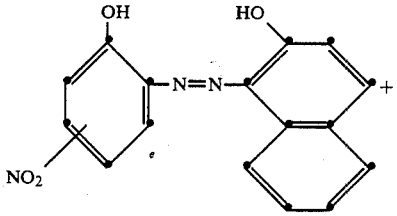

(14)

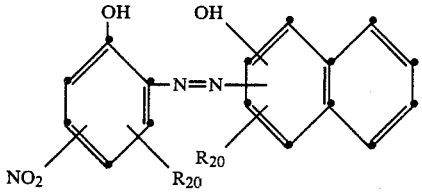

in which one $R_{20}$ is hydrogen while the other is sulfo;

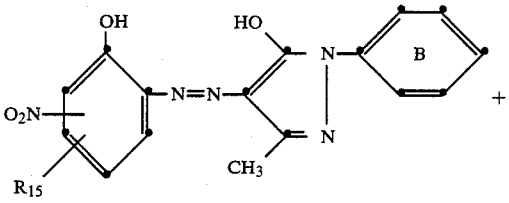

(15)

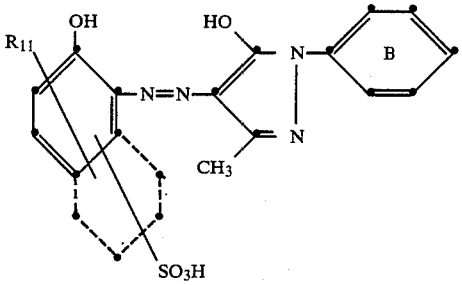

in which $R_{11}$ is as defined under the formula (9), $R_{15}$ is as defined under the formula (11) and phenyl rings B, independently of each other, can each contain the substituents given under the formula (6);

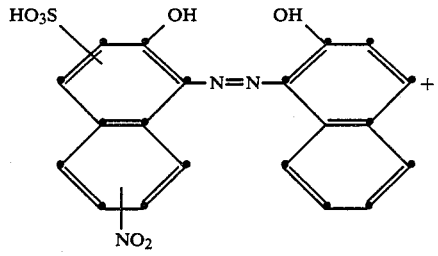

(16)

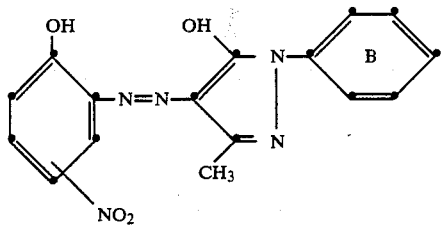

(17)

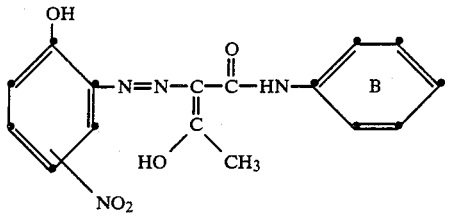

(18)

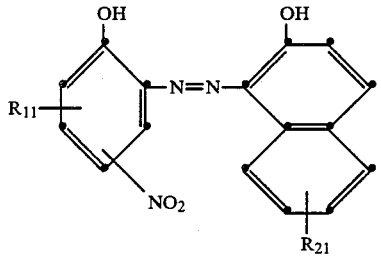

(19)

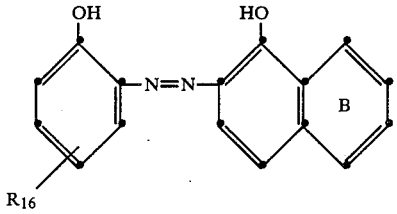

in which the phenyl ring B in the formulae (16), (17) and (19) can contain the substituents given under the formula (6), $R_{11}$ is as defined under the formula (9), $R_{21}$ is hydrogen, methoxycarbonylamino or acetylamino, and $R_{16}$ is as defined under the formula (11);

1:2 chromium complex dyes of azo dyes of the formulae (10)+(11);

1:2 chromium mixed complexes of azo dyes of the formulae (10) and (11);

anthraquinone dyes of the formulae (20) to (22)

(20)

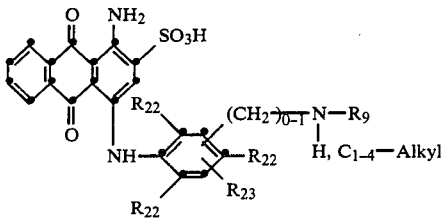

in which $R_9$ is as defined under the formula (6), the $R_{22}$s, independently of each other, are each hydrogen or $C_{1-4}$-alkyl, and $R_{23}$ is hydrogen, sulfo or the $—CH_2—NH—R_9$ radical;

(21)

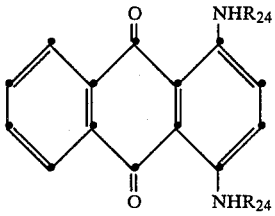

in which the $R_{24}$s, independently of each other, are each cyclohexyl or a diphenyl ether radical which can be substituted by sulfo or a $—CH_2NH—R_9$ radical in which $R_9$ is as defined under the formula (6); and (22)

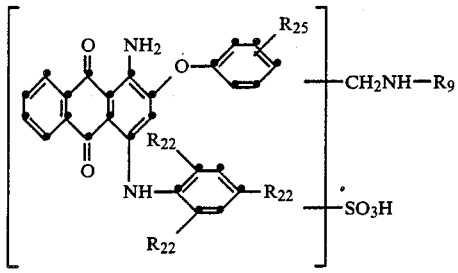

in which $R_9$ is as defined under the formula (6), $R_{22}$ is as defined under the formula (20), and $R_{25}$ is $C_{4-8}$-alkyl, and the benzo rings drawn with broken lines in the formulae (11) and (15) are a benzo ring which can be fused on to the phenol radical drawn with solid lines.

5. A process according to claim 4 for trichromatic dyeing, which comprises using a mixture of at least three anionic dyes from among yellow- or orange-, red- and blue-dyeing dyes.

6. A process according to claim 1, wherein the anionic dyes used have a degree of exhaustion of at least 97% at 1/1 standard depth of shade.

7. A process according to claim 1, wherein the dyeing assistant mixture used consists of 5 to 70 parts of compounds of the formula (1), 15 to 60 parts of a compound of the formula (2) and 5 to 60 parts of a compound of the formula (3), based on 100 parts of dyeing assistant mixture, and in the formulae (1), (2) and (3) R, R′ and R″, independently of one another, are each an alkyl or alkylene radical having 16 to 22 carbon atoms.

8. A process according to claim 1, wherein, in the compound of formula (2) used, A and Q are derived from the quaternising agents chloroacetamide, ethylene chlorohydrin, ethylene bromohydrin, epichlorohydrin, epibromohydrin or dimethyl sulfate.

9. A process according to claim 1, wherein the dyeing assistant mixture used, in addition to the compounds of the formulae (1), (2) and (3), also contains an adduct of 60 to 100 parts of ethylene oxide on a $C_{15-20}$-alkenyl alcohol.

10. A process according to claim 1, wherein the dyeing assistant mixture of the type defined is used in an amount of 0.5 to 2 percent by weight on weight of fibre and the alkali metal salt used is an alkali metal acetate.

11. A process according to claim 10, wherein the alkali metal acetate is used in an amount of 2 g/l on weight of fibre.

12. A process according to claim 1, wherein acetic acid is used to bring the dyeing liquor to pH 5–7.

13. A process according to claim 4, employing dyes of the formulae (62) to (65)

(62)

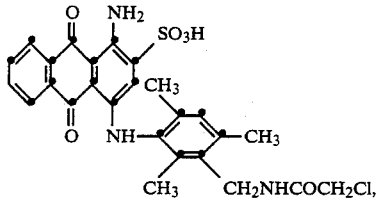

(62a)

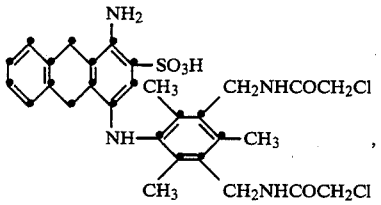

(63)

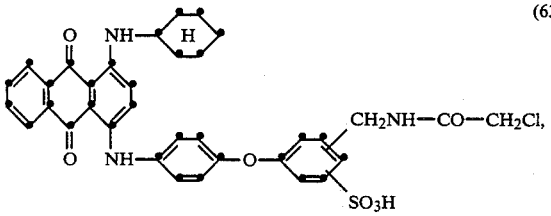

(64)

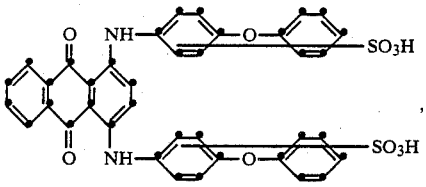

(65)

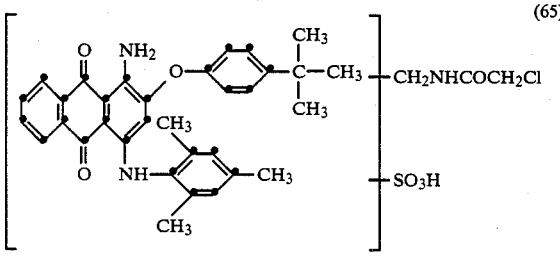

and dye mixtures of dyes of the formulae (23)+(24)+(30)+(39)

(24)

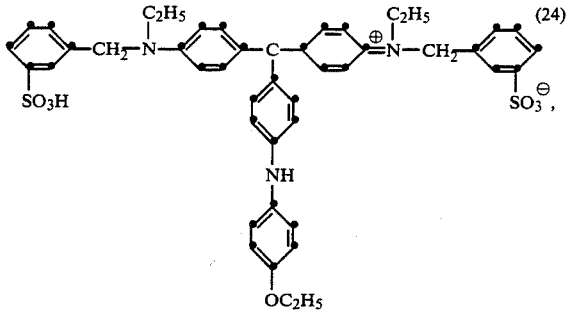

(39)

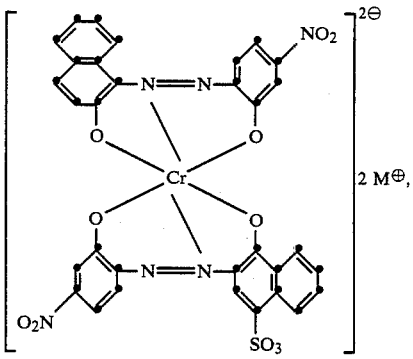

(23)

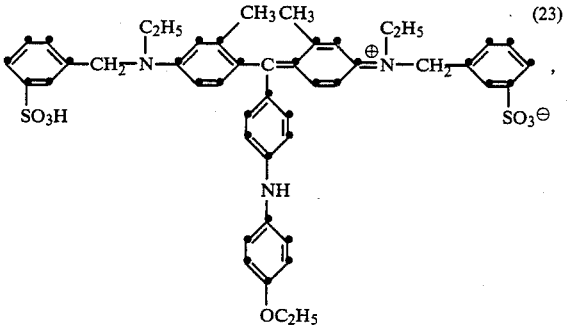

(30)

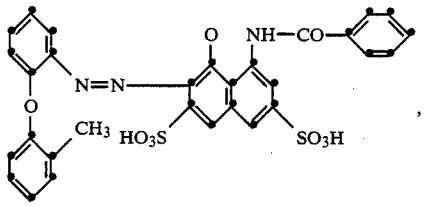

dye mixtures of dyes of the formulae (25)+(42)

(25)

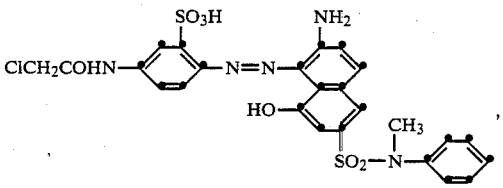

-continued
(42)
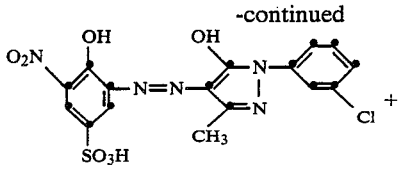
+
-continued
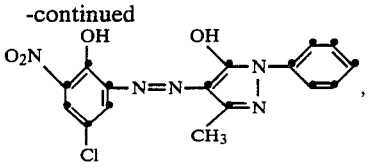
dye mixtures of dyes of the formulae (26)+(26a)+(27)
(26)
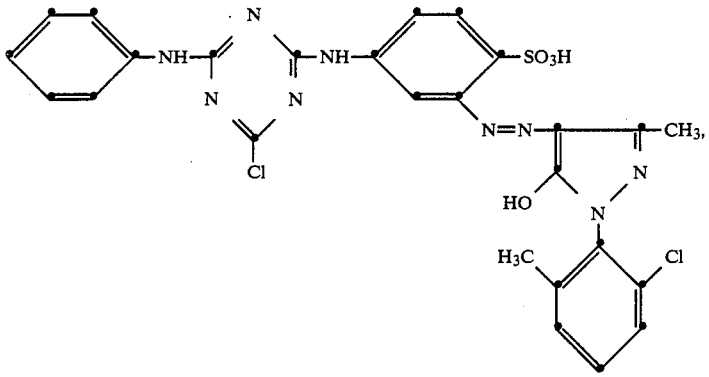
(26a)
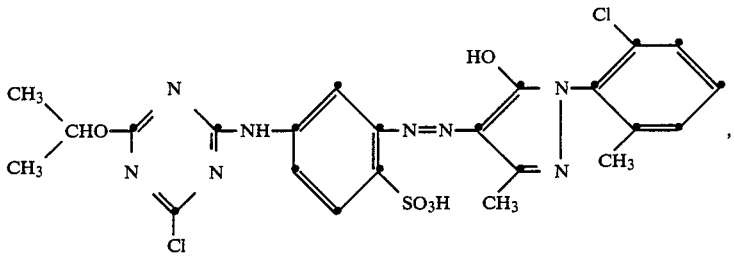
(27)
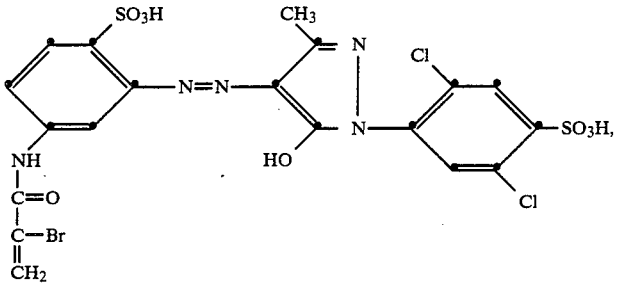
dye mixtures of dyes of the formulae (31)+(38)
(31)
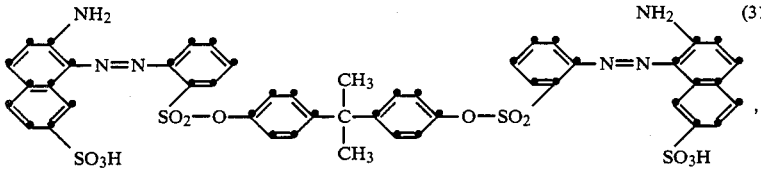

-continued
(38)
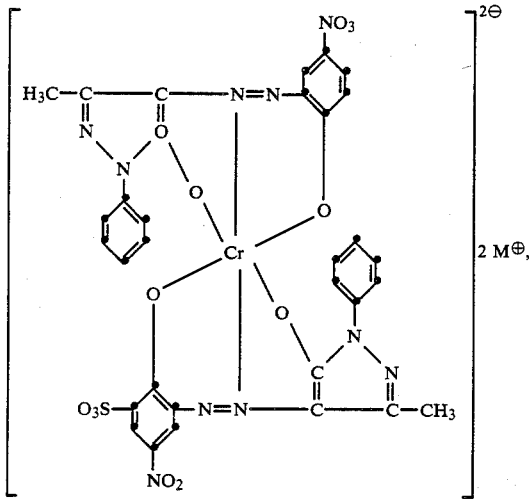
dye mixtures of dyes of the formulae (40)+(44)
(40)
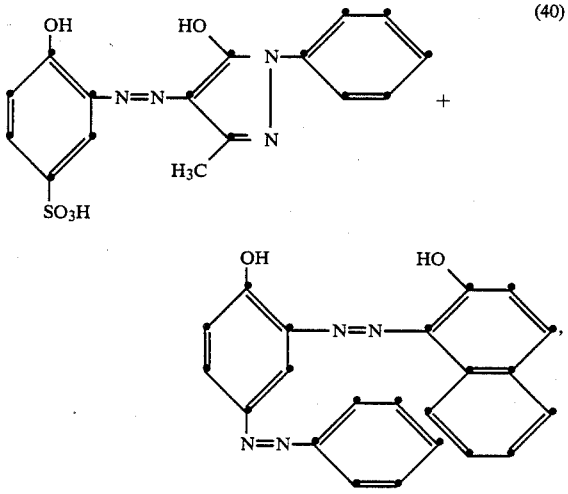
1:2 chromium complexes
(44)
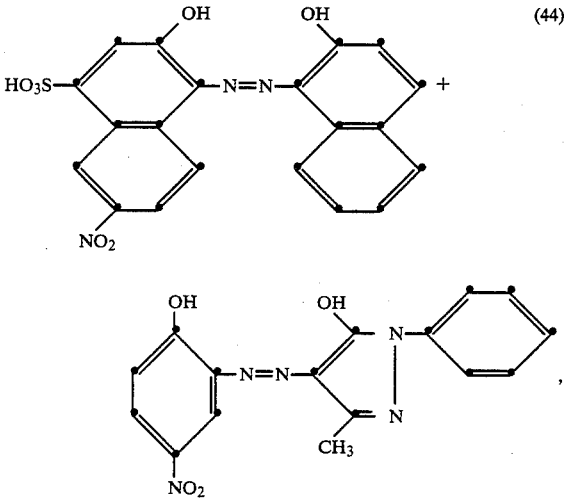
-continued
1:2 chromium complex
dye mixtures of dyes of the formulae (41)+(54)
(41)
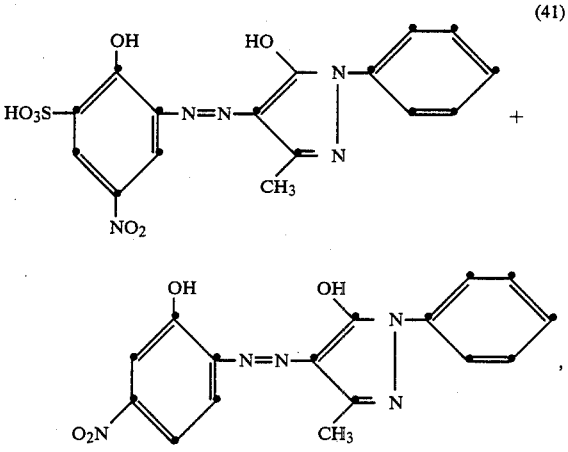
1:2 chromium complex
(54)
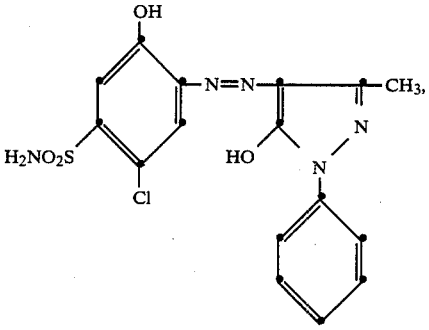
1:2 chromium complex
dye mixtures of dyes of the formulae (32)+(37)+(56)

(32)
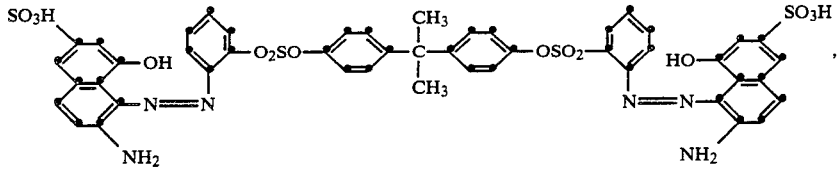
(37)
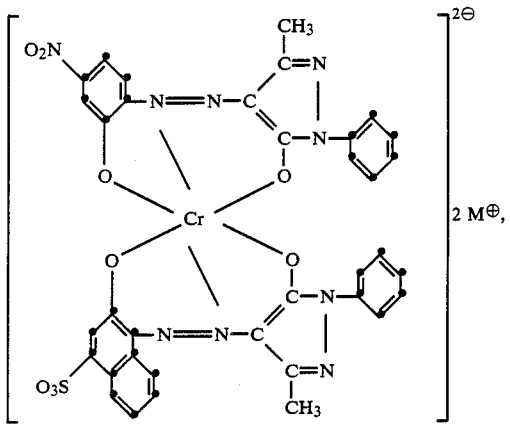
(56)
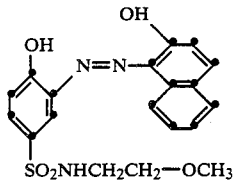
1:2 cobalt complex
dye mixtures of dyes of the formulae (35)+(39)+(53)+(57)
(35)
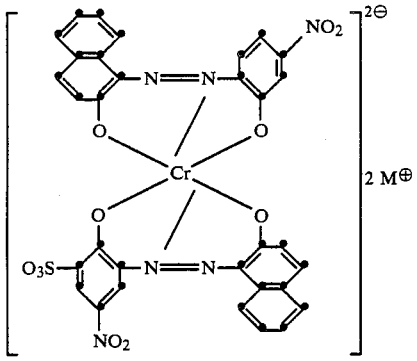
(53)
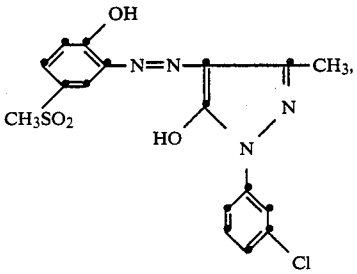
1:2 chromium complex
-continued
(57)
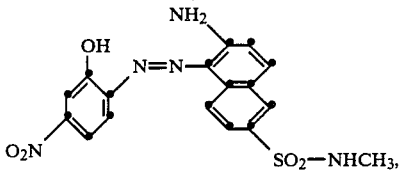
1:2 cobalt complex
dye mixtures of dyes of the formulae (36)+(51)+(53)
(36)
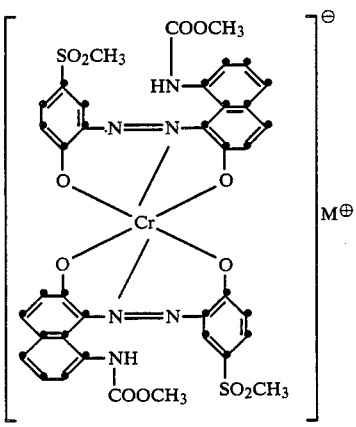

-continued (51)

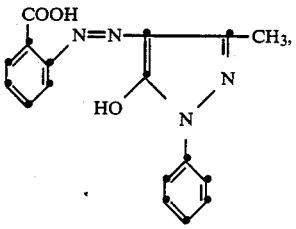

1:2 chromium complex dye mixtures of dyes of the formulae (43)+(45)+(46)+(47)+(49)

(43)

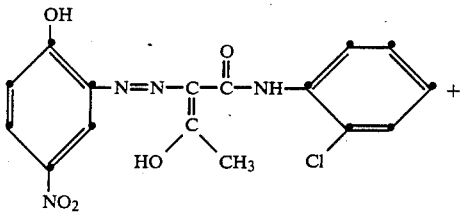

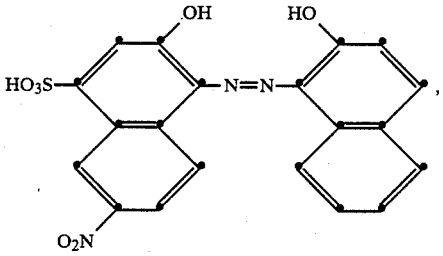

1:2 chromium complex (45)

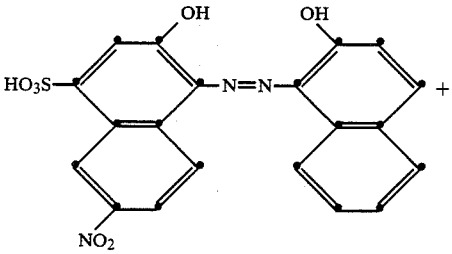

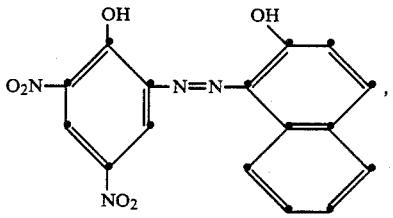

1:2 chromium complex (46)

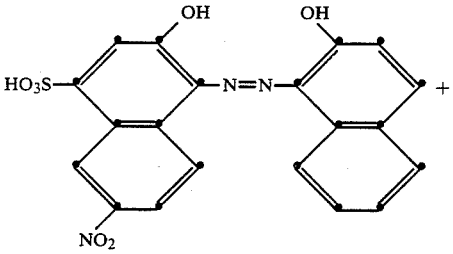

-continued

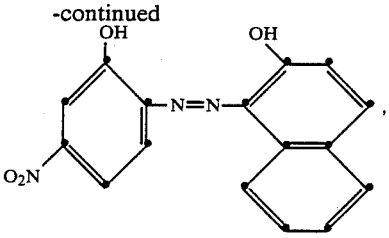

1:2 chromium complex (47)

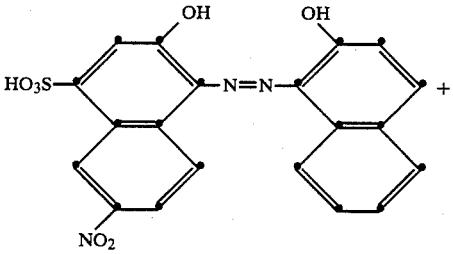

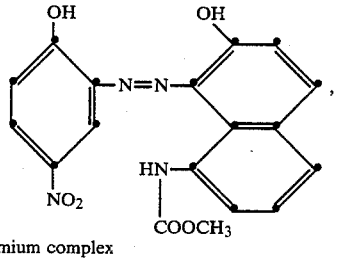

1:2 chromium complex (49)

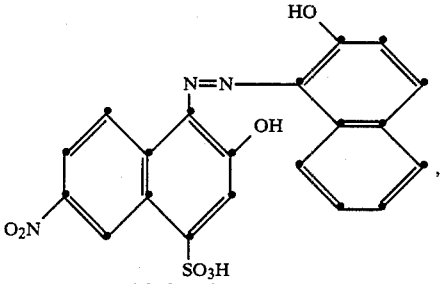

1:2 chromium complex and dye mixtures of dyes of the formulae (51)+(55)

(55)

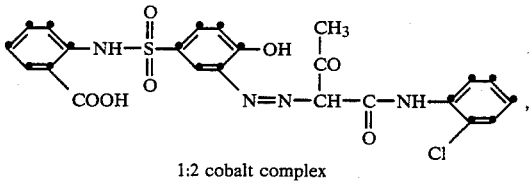

1:2 cobalt complex where, in the formulae (35) to (39), $M^{\oplus}$ is an alkali metal, alkaline earth metal or ammonium ion.

14. A process according to claim 1, wherein dyeing takes place at temperatures between 95° and 130° C. from an aqueous liquor by the exhaust method.

15. A process according to claim 8, wherein, in the compound of formula (2) used, A and Q are derived from dimethyl sulfate.

16. A process according to claim 10, wherein 1 percent by weight is used.

17. A process according to claim 10, wherein sodium acetate is used as alkali metal acetate.

18. A process according to claim 12, wherein acetic acid is used to bring the dyeing liquor to pH 5.5 to 6.0.

* * * * *